US012091997B1

(12) United States Patent
Arora et al.

(10) Patent No.: US 12,091,997 B1
(45) Date of Patent: Sep. 17, 2024

(54) REMOTE ENGINE OIL DRAIN

(71) Applicant: CNH Industrial America LLC, New Holland, PA (US)

(72) Inventors: Nitin Arora, New Holland, PA (US); Daniel Morey, New Holland, PA (US); Nikolay Popov, New Holland, PA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 18/308,465

(22) Filed: Apr. 27, 2023

(51) Int. Cl.
*F01M 11/04* (2006.01)

(52) U.S. Cl.
CPC ..... *F01M 11/0458* (2013.01); *F01M 11/0408* (2013.01); *F01M 2011/0416* (2013.01)

(58) Field of Classification Search
CPC ..... F01M 11/0458; F01M 11/0408; F01M 2011/0416
USPC ..... 184/1
See application file for complete search history.

(56) References Cited

U.S. PATENT DOCUMENTS

| | | | | |
|---|---|---|---|---|
| D246,456 | S | 11/1977 | Mitsui | |
| D266,518 | S | 10/1982 | Harris | |
| 4,709,722 | A | 12/1987 | Knapp | |
| 4,901,693 | A | 2/1990 | Grazia | |
| 5,018,491 | A | 5/1991 | Fish | |
| 5,257,678 | A | 11/1993 | Stokes | |
| 5,454,960 | A | 10/1995 | Newsom | |
| 5,957,170 | A | 9/1999 | Bedi et al. | |
| 10,871,249 | B1 * | 12/2020 | Burns | F01M 11/0408 |
| 11,293,314 | B1 * | 4/2022 | Eisenbach | B60S 5/00 |
| 2015/0096622 | A1 | 4/2015 | Nguyen | |
| 2016/0130995 | A1 * | 5/2016 | England | F01M 11/0004 184/1.5 |
| 2016/0252191 | A1 * | 9/2016 | Dillon | F16K 5/06 137/1 |

FOREIGN PATENT DOCUMENTS

| | | | |
|---|---|---|---|
| CN | 206299426 | U | 7/2017 |
| FR | 2578288 | A1 | 9/1986 |

(Continued)

OTHER PUBLICATIONS

CP Performance E-Z Oil Drain Kit https://www.cpperformance.com/p-13338-e-z-oil-drain-kit-fits-oil-pan-drain-plug-holes-with-12-20-thread.aspx.

(Continued)

*Primary Examiner* — Gene O Crawford
*Assistant Examiner* — Emily R Kincaid
(74) *Attorney, Agent, or Firm* — Rickard K. DeMille; Rebecca L. Henkel; Peter K. Zacharias

(57) ABSTRACT

A remote oil drain system and method, which includes a drain fitting with a hose end that can be coupled to a hose, a drain plug end, and a flange at the intersection of the hose end and the drain plug end. The flange having a key that prevents rotation when interfacing with a corresponding keyway. The drain plug configured to engage with internal threads of the drain fitting. A mounting member configured to be coupled to the chassis, its profile allowing the drain plug end of the drain fitting to pass through to the flange. The mounting member having a keyway to interlock with the key of the drain fitting flange. A locking member engaged with the externally threaded surface of the drain fitting and the proximate the mounting member.

20 Claims, 15 Drawing Sheets

(56) References Cited

FOREIGN PATENT DOCUMENTS

| | | | |
|---|---|---|---|
| IN | 02523MU2015 | | 3/2017 |
| JP | 2002-174107 | A | 6/2002 |
| KR | 19990021057 | A | 3/1999 |

OTHER PUBLICATIONS

Discount Inboard Marine Oil Drains/Extractors, https://skidim.com/maintenance/oil-drains-extractors.htm.
Jabsco Permanent Marine Oil Drain Hose Kit; accessed at https://www.wholesalemarine.com/jabsco-permanent-marine-oil-drain-hose-kit/.
VMAC "Remote Engine Oil Drain" https://www.vmacair.com/product-accessory/remote-engine-oil-drain/.

* cited by examiner

REMOTE ENGINE OIL DRAIN

BACKGROUND

An oil pan is a common component of an internal combustion engine that is located at the bottom of the engine block. It is often a large metal pan that is bolted to the bottom of the engine, and it serves as a reservoir for engine oil. The oil pan is designed to collect oil that is pumped through the engine, which then flows back into the pan through a series of small holes or openings. The oil is then picked up by the engine's oil pump and circulated back through the engine, providing lubrication to its moving parts.

In addition to serving as a reservoir for engine oil, the oil pan also helps to dissipate heat that is generated by the engine. As the engine operates, it can generate significant amounts of heat, which can cause the oil to become overheated and less effective at lubricating the engine's moving parts. The oil pan helps to dissipate this heat, allowing the oil to remain at a more consistent temperature and providing better lubrication to the engine.

Engine oil serves as a lubricant for the engine's moving parts, reducing friction and wear between metal surfaces. Regular oil changes help ensure that the oil remains effective at performing this function, helping to keep the engine running smoothly and efficiently.

Engine oil also helps to cool the engine by dissipating heat generated by the engine's moving parts. Engine oil can become contaminated with dirt, debris, and other particles that can reduce its effectiveness as a lubricant. Regular oil changes help to remove these contaminants and keep the oil clean, helping to ensure that it remains effective at lubricating and cooling the engine.

Regular oil changes are an essential part of maintaining the health and longevity of the engine. Over time, engine oil can become contaminated with dirt, debris, and other particles that can reduce its effectiveness as a lubricant. This can cause increased friction and wear on the engine's moving parts, leading to reduced engine performance, increased fuel consumption, and potentially engine damage. Changing the oil increases lubrication, increases cooling, decreases engine contamination, and improves overall engine health.

While important to the longevity of the engine, operators often overlook changing the oil of the engine. The more difficult it is to change the oil, the greater the chance that an operator will forego this important task. As vehicles become more efficient, the components of the engine become smaller and more tightly packed. This can lead to the oil pan drain (which is accessed during the oil-change process) being inaccessible or difficult to access. The more difficult it is to access the oil pan drain, the more likely that an operator will overlook changing the oil.

SUMMARY

What is needed is a remote oil drain system that is easy to assemble during manufacturing and easy to access for service.

One embodiment relates to an agricultural vehicle. The agricultural vehicle may include a chassis. The agricultural vehicle may also include an oil pan, including a drain. The agricultural vehicle may furthermore include an oil pan drain hose having a first end and a second end, where the first end is cooperatively coupled to the drain. The agricultural vehicle may in addition include a drain fitting including: a hose end cooperatively coupled to the second end of the oil pan drain hose; a drain plug end, the drain plug end having an externally threaded surface on an outer surface of the drain plug end and having internal threads on an inner surface of the drain plug end; a flange, located at an intersection of the hose end and the drain plug end, the flange extending radially outward from the hose end and the drain plug end and having a key configured to prevent rotation upon interfacing with a corresponding keyway. The agricultural vehicle may moreover include a drain plug, where the drain plug includes external threads on a threaded end configured to physically engage with the internal threads of the drain plug end of the drain fitting. The agricultural vehicle may also include a mounting member, configured to be coupled to the chassis, the mounting member having a profile configured to allow the drain plug end of the drain fitting to pass through to the flange until the flange is located proximate a mounting member interior surface, the mounting member including a keyway in the profile to interlock with the key of the drain fitting. The agricultural vehicle may furthermore include a locking member with interior threads on a locking member interior surface for physically engaging with the externally threaded surface of the drain fitting and configured to removeably engage with the mounting member on an exterior surface of the mounting member. Other embodiments of this aspect include corresponding computer systems, apparatus, and computer programs recorded on one or more computer storage devices, each configured to perform the actions of the methods.

Implementations may include one or more of the following features. In some embodiments, the first end of the oil pan drain hose is cooperatively coupled to the drain by an adapter. In some embodiments, the drain fitting is made of a ferrous material. In some embodiments, the hose end of the drain fitting includes hose barbs configured to physically engage with the oil pan drain hose. In some embodiments, the locking member is a jam nut. In some embodiments, the mounting member is removeably coupled to the chassis. In some embodiments, the drain plug includes ports through the threaded end, configured to allow a fluid pass through for draining. Implementations of the described techniques may include hardware, a method or process, or a computer tangible medium.

In one general aspect, a remote oil drain system may include a drain fitting including: a hose end cooperatively coupled to a hose; a drain plug end, the drain plug end having an externally threaded surface on an outer surface of the drain plug end and having internal threads on an inner surface of the drain plug end; a flange, located at an intersection of the hose end and the drain plug end, the flange extending radially outward from the hose end and the drain plug end and having a key configured to prevent rotation upon interfacing with a corresponding keyway. The remote oil drain system may also include a drain plug, where the drain plug includes external threads on a threaded end configured to physically engage with the internal threads of the drain plug end of the drain fitting. The system may furthermore include a mounting member, configured to be coupled to a chassis, the mounting member having a profile configured to allow the drain plug end of the drain fitting to pass through to the flange until the flange is located proximate a mounting member interior surface, the mounting member including a keyway in the profile to interlock with the key of the drain fitting. The system may, in addition include, a locking member with interior threads on a locking member interior surface for physically engaging with the externally threaded surface of the drain fitting and configured to removeably engage with the mounting member on an exterior surface of the mounting member. Other embodiments of this aspect include corresponding computer systems, apparatus, and computer programs recorded on one or more computer storage devices, each configured to perform the actions of the methods.

Implementations may include one or more of the following features. In some embodiments, a first end of an oil pan drain hose is cooperatively coupled to a drain by an adapter. In some embodiments, the drain fitting is made of a ferrous material. In some embodiments, the hose end of the drain fitting includes hose barbs configured to physically engage with an oil pan drain hose. In some embodiments, the locking member is a jam nut. In some embodiments, the mounting member is removeably coupled to the chassis. In some embodiments, the drain plug includes ports through the threaded end, configured to allow a fluid pass through for draining. Implementations of the described techniques may include hardware, a method or process, or a computer tangible medium.

Another implementation of the present disclosure relates to a method, the method may include filling an oil pan of the agricultural vehicle with oil prior to the installation on the agricultural vehicle, the oil pan having a drain and a hose cooperatively coupled thereto at a first end of the hose, the hose having a second end cooperatively coupled to a drain fitting made of a ferrous material. The method may also include coupling an installation member to the drain fitting, the installation member extending through a hole in a chassis of the agricultural vehicle. The method may furthermore include during the installation of the oil pan onto the agricultural vehicle, pulling the drain fitting through the hole in the chassis of the agricultural vehicle. The method may in addition include mounting the drain fitting to a mounting member, the mounting member cooperatively coupled to the chassis of the agricultural vehicle. Other embodiments of this aspect include corresponding computer systems, apparatus, and computer programs recorded on one or more computer storage devices, each configured to perform the actions of the methods.

Implementations may include one or more of the following features. In some embodiments, the mounting member is removeably coupled to the chassis of the agricultural vehicle. In some embodiments, the agricultural vehicle is a tractor. In some embodiments, the mounting member is irremoveably coupled to the chassis of the agricultural vehicle. In some embodiments, the installation member is magnetically coupled to the drain fitting. In some embodiments, the installation is physically coupled to the drain fitting. Implementations of the described techniques may include hardware, a method or process, or a computer tangible medium.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

DETAILED DESCRIPTION

Figure 1:
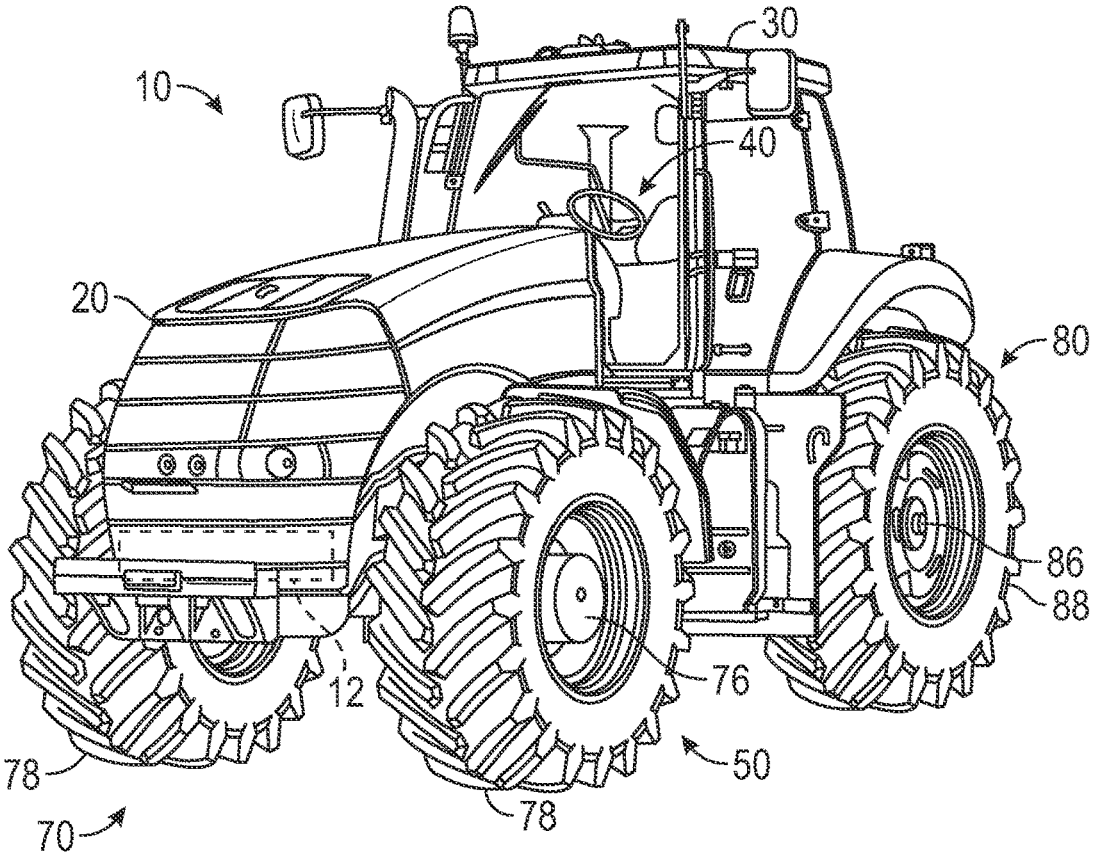
FIG. 1 is a perspective view of a vehicle, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

By way of an exemplary embodiment, a remote oil drain system and installation process thereof is described herein. The remote oil drain system of the present disclosure allows an engine, to which the remote oil drain system is connected, to be filled with oil prior to assembling the engine into the chassis. The remote oil drain system can then be safely fixed in position after the engine is assembled onto the chassis.

During the manufacturing phase of the engine, the remote oil drain system is attached to an oil pan which is fitted to an engine. The remote oil drain system may include a drain hose, hose clamps, a drain fitting, a mounting member, a jam nut, and a ported drain plug.

The drain hose is removeably fixed to the oil pan. This may be done directly or through an adapter which is attached to the oil pan. The drain hose is attached to the oil pan (or adapter) by suitable means, such as hose clamps. The hose clamps may be a worm gear hose clamps. These may consist of a band with a screw mechanism that tightens around the hose.

The hose clamps may also be spring clamps. These are small, lightweight clamps that use a spring to apply pressure to the hose. The hose clamps may be ear clamps. These clamps consist of a band with "ears" that are crimped together using a special tool to create a tight seal around the hose. The hose clamps may be T-bolt clamps. These are heavy-duty clamps that use a T-shaped bolt to apply pressure to the hose. The hose clamps may be double ear clamps. Similar to ear clamps, double ear clamps have two "ears" that are crimped together to create a secure seal around the hose. The hose clamps may be wire clamps: These clamps use a wire that is wrapped around the hose and tightened using pliers.

The drain hose is then attached, at the other end, to a keyed drain fitting. The drain fitting includes at least one hose bar on a hose end to help grip the inside of the hose and hold it securely in place. A hose clamp is again used to securely attach the hose to the drain fitting. The drain fitting is installed with a drain plug. This closes the drain system and allows the engine to be filled with oil prior to installing the engine onto the chassis of the vehicle. Because the hose can be any length, the drain fitting can be placed virtually anywhere on the vehicle to increase accessibility. To improve functionality, the drain fitting is placed at an elevation below the oil pan to ensure steady oil flow during the draining/oil changing process. According to an exemplary embodiment, the drain fitting is placed through an opening in the frame to allow for easy access. However, this placement may cause difficulty during installation of the engine. To aid in safely installing the oil drain system, the drain fitting or drain plug is made of a ferrous material. A cable with a magnetic end may be fed through the opening in the frame prior to the engine being installed onto the chassis. As the engine is installed, the cable is pulled through the hole in the frame and the drain fitting is guided through the hole. Once the fitting is pulled through the frame, a keyed mounting plate can be put into position. The keyed mounting plate is configured to interface with the keyed drain fitting. The keyed interface of the keyed drain fitting and the keyed mounting plate prevents rotation of the drain fitting when removing or installing the drain plug in service. Once the mounting plate is installed onto the frame (e.g., by welding, bolting, etc.), a jam nut is installed on the drain fitting to secure the drain fitting to the plate. In some embodiments, the hole in the frame includes a keyway, which may remove the need for a separate mounting plate.

In some embodiments, the drain plug may be replaced with a drain valve. The drain valve can accept a hose with an attachment to actuate the drain valve.

In some embodiments, the remote drain can be in vertical orientation as opposed to the more horizontal configuration shown in the various figures herein.

In some embodiments, the drain plug and fitting can have porting (cross drills and passages) so that the plug need not be fully removed to drain oil. Additionally, the drain plug with porting can also have a hose barb to accept a hose to permit a more controlled drain of the oil into a collection vessel.

In some embodiments, a hook or other tool can be used to guide the drain fitting though the opening of the frame instead of a cable with a magnetic end.

Overall Vehicle

Figure 2:
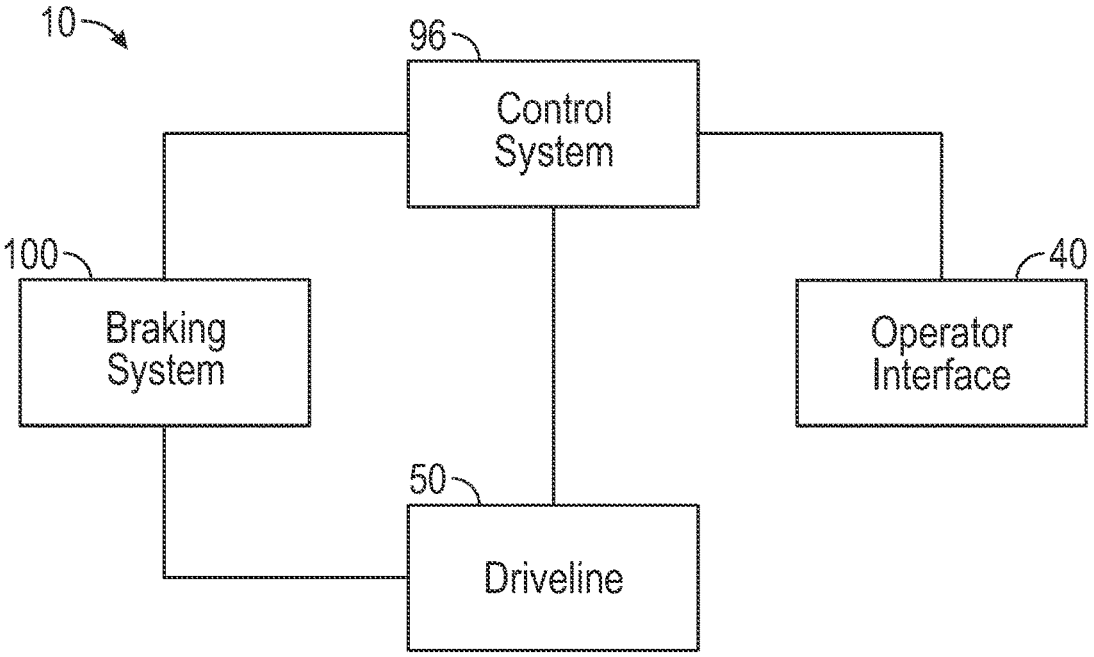
FIG. 2 is a schematic block diagram of the vehicle of FIG. 1, according to an exemplary embodiment.
Figure 3:
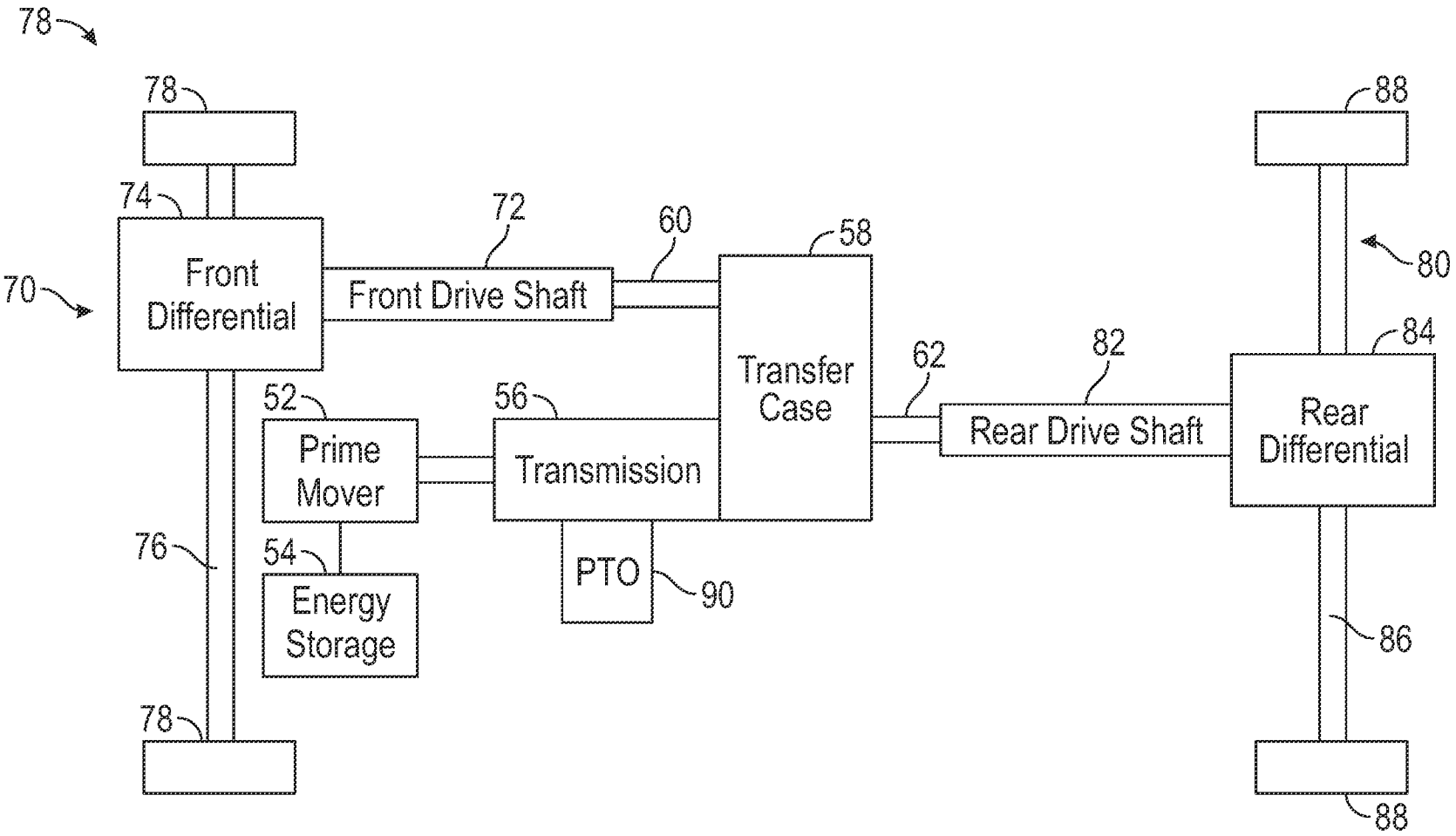
FIG. 3 is a schematic block diagram of a driveline of the vehicle of FIG. 1, according to an exemplary embodiment.
Figure 4:
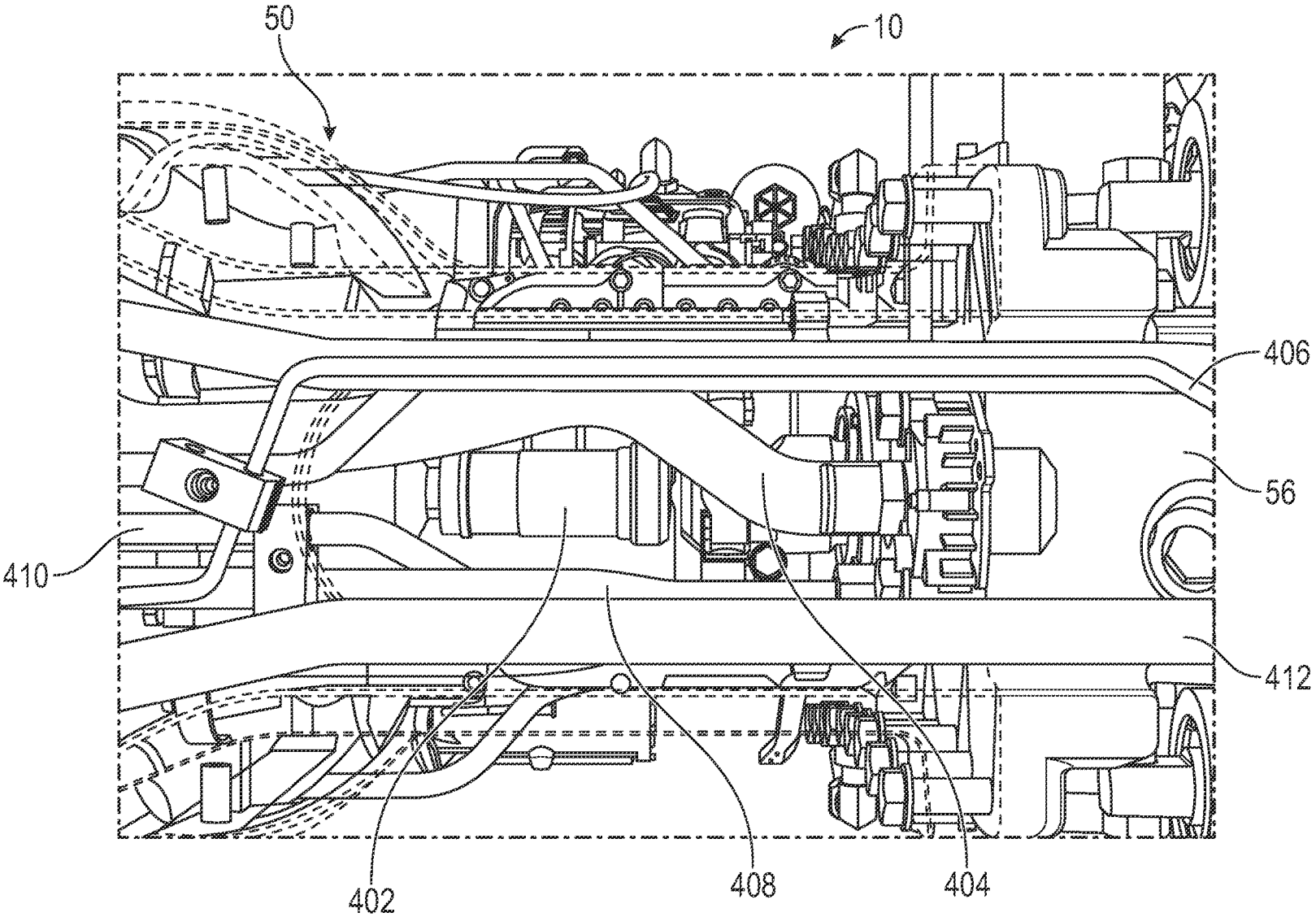
FIG. 4 is a side view of the interior of the vehicle of FIG. 1, according to an exemplary embodiment.

According to the exemplary embodiment shown in FIGS. 1-3, a machine or vehicle, shown as vehicle 10, includes a chassis, shown as frame 12; a body assembly, shown as body 20, coupled to the frame 12 and having an occupant portion or section, shown as cab 30; operator input and output devices, shown as operator interface 40, that are disposed within the cab 30; a drivetrain, shown as driveline 50, coupled to the frame 12 and at least partially disposed under the body 20; a vehicle braking system, shown as braking system 100, coupled to one or more components of the driveline 50 to facilitate selectively braking the one or more components of the driveline 50; and a vehicle control system, shown as control system 96, coupled to the operator interface 40, the driveline 50, and the braking system 100. In other embodiments, the vehicle 10 includes more or fewer components.

The chassis of the vehicle 10 may include a structural frame (e.g., the frame 12) formed from one or more frame members coupled to one another (e.g., as a weldment). Additionally or alternatively, the chassis may include a portion of the driveline 50. By way of example, a component of the driveline 50 (e.g., the transmission 52) may include a housing of sufficient thickness to provide the component with strength to support other components of the vehicle 10.

According to an exemplary embodiment, the vehicle 10 is an off-road machine or vehicle. In some embodiments, the off-road machine or vehicle is an agricultural machine or vehicle such as a tractor, a telehandler, a front loader, a combine harvester, a grape harvester, a forage harvester, a sprayer vehicle, a speedrower, and/or another type of agricultural machine or vehicle. In some embodiments, the off-road machine or vehicle is a construction machine or vehicle such as a skid steer loader, an excavator, a backhoe loader, a wheel loader, a bulldozer, a telehandler, a motor grader, and/or another type of construction machine or vehicle. In some embodiments, the vehicle 10 includes one or more attached implements and/or trailed implements such as a front mounted mower, a rear mounted mower, a trailed mower, a tedder, a rake, a baler, a plough, a cultivator, a rotavator, a tiller, a harvester, and/or another type of attached implement or trailed implement.

According to an exemplary embodiment, the cab 30 is configured to provide seating for an operator (e.g., a driver, etc.) of the vehicle 10. In some embodiments, the cab 30 is configured to provide seating for one or more passengers of the vehicle 10. According to an exemplary embodiment, the operator interface 40 is configured to provide an operator with the ability to control one or more functions of and/or provide commands to the vehicle 10 and the components thereof (e.g., turn on, turn off, drive, turn, brake, engage various operating modes, raise/lower an implement, etc.). The operator interface 40 may include one or more displays and one or more input devices. The one or more displays may be or include a touchscreen, a LCD display, a LED display, a speedometer, gauges, warning lights, etc. The one or more input device may be or include a steering wheel, a joystick, buttons, switches, knobs, levers, an accelerator pedal, a brake pedal, etc.

According to an exemplary embodiment, the driveline 50 is configured to propel the vehicle 10. As shown in FIG. 3, the driveline 50 includes a primary driver, shown as prime mover 52, and an energy storage device, shown as energy storage 54. In some embodiments, the driveline 50 is a conventional driveline whereby the prime mover 52 is an internal combustion engine and the energy storage 54 is a fuel tank. The internal combustion engine may be a spark-ignition internal combustion engine or a compression-ignition internal combustion engine that may use any suitable fuel type (e.g., diesel, ethanol, gasoline, natural gas, propane, etc.). In some embodiments, the driveline 50 is an electric driveline whereby the prime mover 52 is an electric motor and the energy storage 54 is a battery system. In some embodiments, the driveline 50 is a fuel cell electric driveline whereby the prime mover 52 is an electric motor and the energy storage 54 is a fuel cell (e.g., that stores hydrogen, that produces electricity from the hydrogen, etc.). In some embodiments, the driveline 50 is a hybrid driveline whereby (i) the prime mover 52 includes an internal combustion engine and an electric motor/generator and (ii) the energy storage 54 includes a fuel tank and/or a battery system.

As shown in FIG. 3, the driveline 50 includes a transmission device (e.g., a gearbox, a continuous variable transmission ("CVT"), etc.), shown as transmission 56, coupled to the prime mover 52; a power divider, shown as transfer case 58, coupled to the transmission 56; a first tractive assembly, shown as front tractive assembly 70, coupled to a first output of the transfer case 58, shown as front output 60; and a second tractive assembly, shown as rear tractive assembly 80, coupled to a second output of the transfer case 58, shown as rear output 62. According to an exemplary embodiment, the transmission 56 has a variety of configurations (e.g., gear ratios, etc.) and provides different output speeds relative to a mechanical input received thereby from the prime mover 52. In some embodiments (e.g., in electric driveline configurations, in hybrid driveline configurations, etc.), the driveline 50 does not include the transmission 56. In such embodiments, the prime mover 52 may be directly coupled to the transfer case 58. According to an exemplary embodiment, the transfer case 58 is configured to facilitate driving both the front tractive assembly 70 and the rear tractive assembly 80 with the prime mover 52 to facilitate front and rear drive (e.g., an all-wheel-drive vehicle, a four-wheel-drive vehicle, etc.). In some embodiments, the transfer case 58 facilitates selectively engaging rear drive only, front drive only, and both front and rear drive simultaneously. In some embodiments, the transmission 56 and/or the transfer case 58 facilitate selectively disengaging the front tractive assembly 70 and the rear tractive assembly 80 from the prime mover 52 (e.g., to permit free movement of the front tractive assembly 70 and the rear tractive assembly 80 in a neutral mode of operation). In some embodiments, the driveline 50 does not include the transfer case 58. In such embodiments, the prime mover 52 or the transmission 56 may directly drive the front tractive assembly 70 (i.e., a front-wheel-drive vehicle) or the rear tractive assembly 80 (i.e., a rear-wheel-drive vehicle).

As shown in FIGS. 1 and 3, the front tractive assembly 70 includes a first drive shaft, shown as front drive shaft 72, coupled to the front output 60 of the transfer case 58; a first differential, shown as front differential 74, coupled to the front drive shaft 72; a first axle, shown front axle 76, coupled to the front differential 74; and a first pair of tractive elements, shown as front tractive elements 78, coupled to the front axle 76. In some embodiments, the front tractive assembly 70 includes a plurality of front axles 76. In some embodiments, the front tractive assembly 70 does not include the front drive shaft 72 or the front differential 74 (e.g., a rear-wheel-drive vehicle). In some embodiments, the front drive shaft 72 is directly coupled to the transmission 56 (e.g., in a front-wheel-drive vehicle, in embodiments where the driveline 50 does not include the transfer case 58, etc.) or the prime mover 52 (e.g., in a front-wheel-drive vehicle, in embodiments where the driveline 50 does not include the transfer case 58 or the transmission 56, etc.). The front axle 76 may include one or more components.

As shown in FIGS. 1 and 3, the rear tractive assembly 80 includes a second drive shaft, shown as rear drive shaft 82, coupled to the rear output 62 of the transfer case 58; a second differential, shown as rear differential 84, coupled to the rear drive shaft 82; a second axle, shown rear axle 86, coupled to the rear differential 84; and a second pair of tractive elements, shown as rear tractive elements 88, coupled to the rear axle 86. In some embodiments, the rear tractive assembly 80 includes a plurality of rear axles 86. In some embodiments, the rear tractive assembly 80 does not include the rear drive shaft 82 or the rear differential 84 (e.g., a front-wheel-drive vehicle). In some embodiments, the rear drive shaft 82 is directly coupled to the transmission 56 (e.g., in a rear-wheel-drive vehicle, in embodiments where the driveline 50 does not include the transfer case 58, etc.) or the prime mover 52 (e.g., in a rear-wheel-drive vehicle, in embodiments where the driveline 50 does not include the transfer case 58 or the transmission 56, etc.). The rear axle 86 may include one or more components. According to the exemplary embodiment shown in FIG. 1, the front tractive elements 78 and the rear tractive elements 88 are structured as wheels. In other embodiments, the front tractive elements 78 and the rear tractive elements 88 are otherwise structured (e.g., tracks, etc.). In some embodiments, the front tractive elements 78 and the rear tractive elements 88 are both steerable. In other embodiments, only one of the front tractive elements 78 or the rear tractive elements 88 is steerable. In still other embodiments, both the front tractive elements 78 and the rear tractive elements 88 are fixed and not steerable.

In some embodiments, the driveline 50 includes a plurality of prime movers 52. By way of example, the driveline 50 may include a first prime mover 52 that drives the front tractive assembly 70 and a second prime mover 52 that drives the rear tractive assembly 80. By way of another example, the driveline 50 may include a first prime mover 52 that drives a first one of the front tractive elements 78, a second prime mover 52 that drives a second one of the front tractive elements 78, a third prime mover 52 that drives a first one of the rear tractive elements 88, and/or a fourth prime mover 52 that drives a second one of the rear tractive elements 88. By way of still another example, the driveline 50 may include a first prime mover that drives the front tractive assembly 70, a second prime mover 52 that drives a first one of the rear tractive elements 88, and a third prime mover 52 that drives a second one of the rear tractive elements 88. By way of yet another example, the driveline 50 may include a first prime mover that drives the rear tractive assembly 80, a second prime mover 52 that drives a first one of the front tractive elements 78, and a third prime mover 52 that drives a second one of the front tractive elements 78. In such embodiments, the driveline 50 may not include the transmission 56 or the transfer case 58.

As shown in FIG. 3, the driveline 50 includes a power-take-off ("PTO"), shown as PTO 90. While the PTO 90 is shown as being an output of the transmission 56, in other embodiments the PTO 90 may be an output of the prime mover 52, the transmission 56, and/or the transfer case 58. According to an exemplary embodiment, the PTO 90 is configured to facilitate driving an attached implement and/or a trailed implement of the vehicle 10. In some embodiments, the driveline 50 includes a PTO clutch positioned to selectively decouple the driveline 50 from the attached implement and/or the trailed implement of the vehicle 10 (e.g., so that the attached implement and/or the trailed implement is only operated when desired, etc.).

According to an exemplary embodiment, the braking system 100 includes one or more brakes (e.g., disc brakes, drum brakes, in-board brakes, axle brakes, etc.) positioned to facilitate selectively braking (i) one or more components of the driveline 50 and/or (ii) one or more components of a trailed implement. In some embodiments, the one or more brakes include (i) one or more front brakes positioned to facilitate braking one or more components of the front tractive assembly 70 and (ii) one or more rear brakes positioned to facilitate braking one or more components of the rear tractive assembly 80. In some embodiments, the one or more brakes include only the one or more front brakes. In some embodiments, the one or more brakes include only the one or more rear brakes. In some embodiments, the one or more front brakes include two front brakes, one positioned to facilitate braking each of the front tractive elements 78. In some embodiments, the one or more front brakes include at least one front brake positioned to facilitate braking the front axle 76. In some embodiments, the one or more rear brakes include two rear brakes, one positioned to facilitate braking each of the rear tractive elements 88. In some embodiments, the one or more rear brakes include at least one rear brake positioned to facilitate braking the rear axle 86. Accordingly, the braking system 100 may include one or more brakes to facilitate braking the front axle 76, the front tractive elements 78, the rear axle 86, and/or the rear tractive elements 88. In some embodiments, the one or more brakes additionally include one or more trailer brakes of a trailed implement attached to the vehicle 10. The trailer brakes are positioned to facilitate selectively braking one or more axles and/or one more tractive elements (e.g., wheels, etc.) of the trailed implement.

Remote Oil Drain System

Referring now to FIGS. 4-13, a remote oil drain is shown. According to an exemplary embodiment shown in FIG. 4, a portion of the drive driveline 50 of vehicle 1. Various components of vehicle 10 are depicted. For example, a line 404 is shown. A line 406 is shown. A line 408 is shown. A line 410 is shown. A line 412 is shown. A front axle drive shaft 402 is shown rotatably coupled to, and driven by, the transmission 56. The various components 402, 404, 406, 408, 410, and 412 are depicted as being tightly packaged, making access to internal components of the vehicle 10 more difficult. While certain internal combustion engine components are shown, it should be understood that the current disclosure may relate to any vehicle, whether or not an internal combustion engine is used. For example, the remote drain assembly of the present disclosure may be adapted to electric vehicles, hybrid vehicles, plug-in hybrid vehicles, fuel cell vehicles using hydrogen fuel cells, compressed natural gas vehicles, propane vehicles, and biofuel vehicles.

Figure 5:
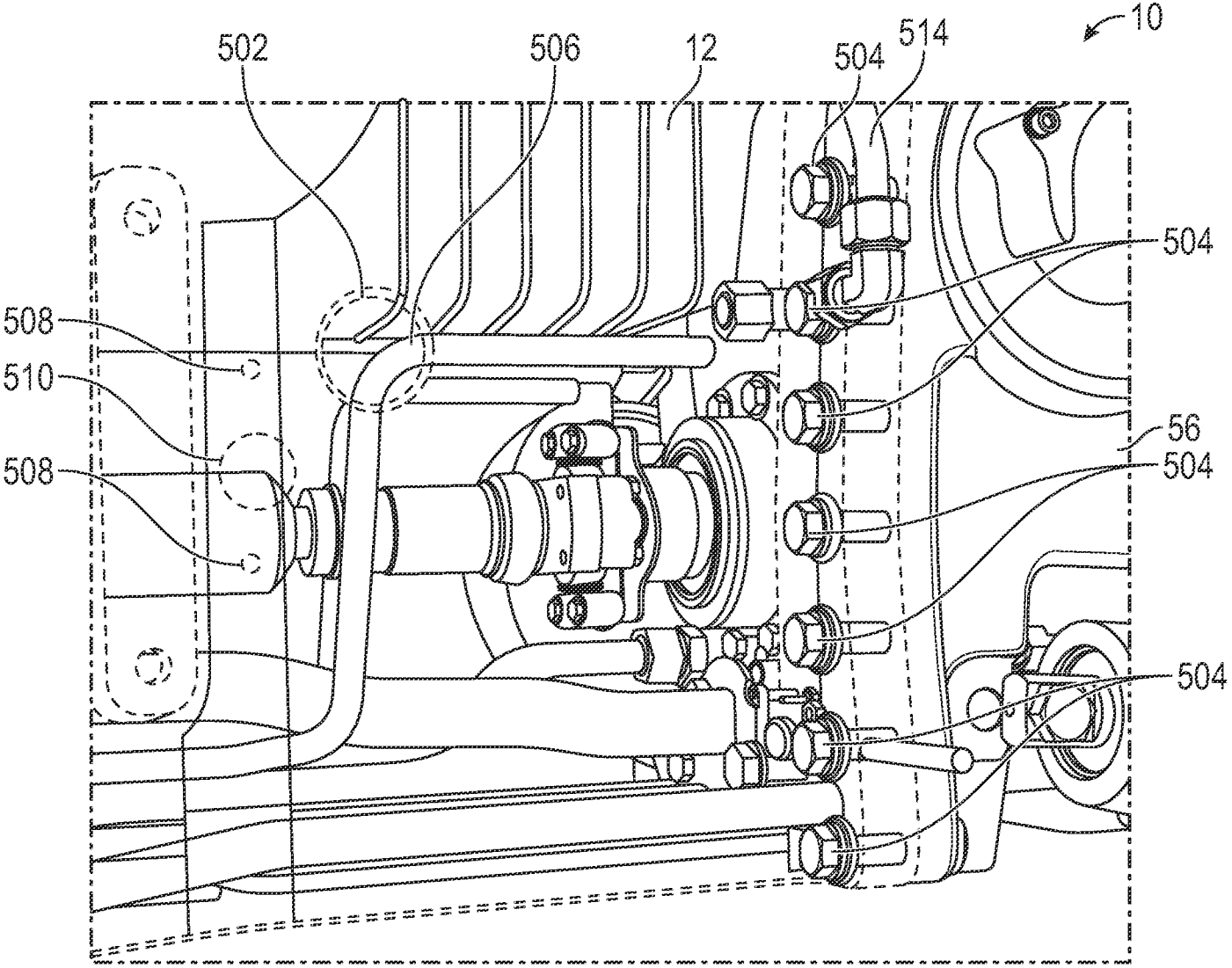
FIG. 5 is a perspective view of a frame of the vehicle of FIG. 1, according to an exemplary embodiment.

According to an exemplary embodiment as shown in FIG. 5, a frame 12 is shown assembled on to the vehicle 10. The frame may be made of any suitable material to support the weight and forces of vehicle 10. In some embodiments, the frame is made of steel. The frame 12 is fixedly coupled to the transmission by bolts 504. In some embodiments, multiple bolts 504 are used to fixedly couple the frame 12 to the transmission 56. The frame 12 may be fixedly coupled to the transmission 56 in any suitable method, including welding. In other embodiments, the transmission 56 is incorporated into the frame 12. In some embodiments, the frame need not be fixedly coupled to the transmission 56. Frame 12 includes an access cutout 502. Access cutout 502 may be created during the casting process when forming the frame 12 during manufacturing. Alternatively, access cutout 502 may be created as a post manufacturing procedure by drilling a hole through frame 12. In some embodiments, the edges of access cutout 502 are dulled to avoid cutting an operator when using the access cutout.

A drain fitting cutout 510 is shown. Just as the access cutout 502, the drain fitting cutout 510 may be formed during the casting process during manufacture of the frame. In other embodiments, the drain fitting cutout 510 is drilled post casting. The drain fitting cutout 510 is configured to interface with a drain fitting as disclosed below. The drain fitting cutout 510 may be any shape or profile to accept the drain fitting. For example, the drain fitting 510 may be a circle, square, triangle, rectangle, oval, or other suitable shape.

Above and below the drain fitting cutout 510, a mount point 508 is shown. Just as the drain fitting cutout 510, the mount point 508 may be created during the casting process when forming the frame 12 during manufacturing. Alternatively, mount point 508 may be created as a post manufacturing procedure by drilling a hole through frame 12. The mount point 508 is configured to accept a bolt or protrusion to fixedly couple a mounting plate to the frame 12. While two mount points 508 are depicted in FIG. 5, it should be understood that any number of mount points 508 may be used to secure the mounting plate to the frame 12. Line 506 is shown through the access cutout 502. However, line 506 may be routed in any orientation and need not pass behind the access cutout 502 as depicted in FIG. 5.

Figure 6A:
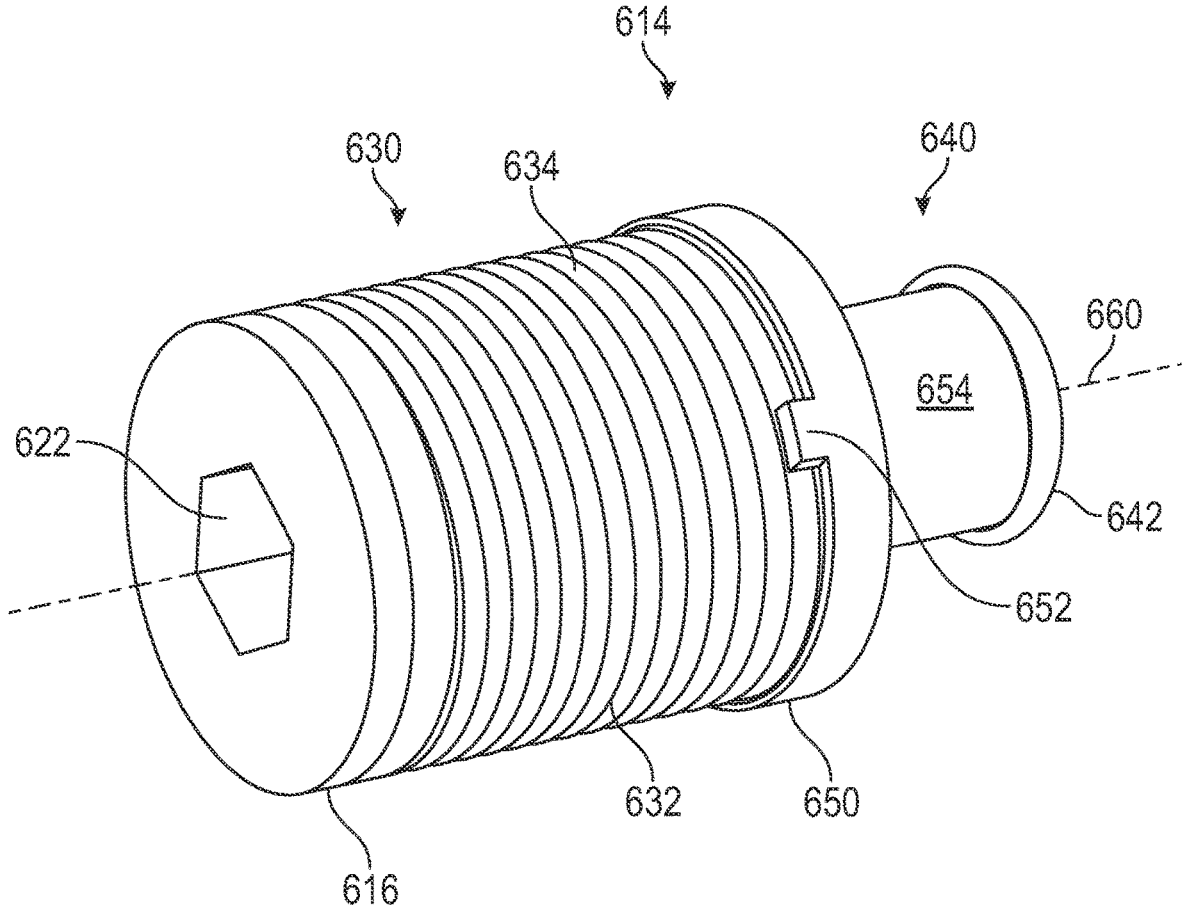
FIG. 6A is a perspective view of a remote oil drain fitting of the vehicle of FIG. 1, according to an exemplary embodiment.
Figure 6C:
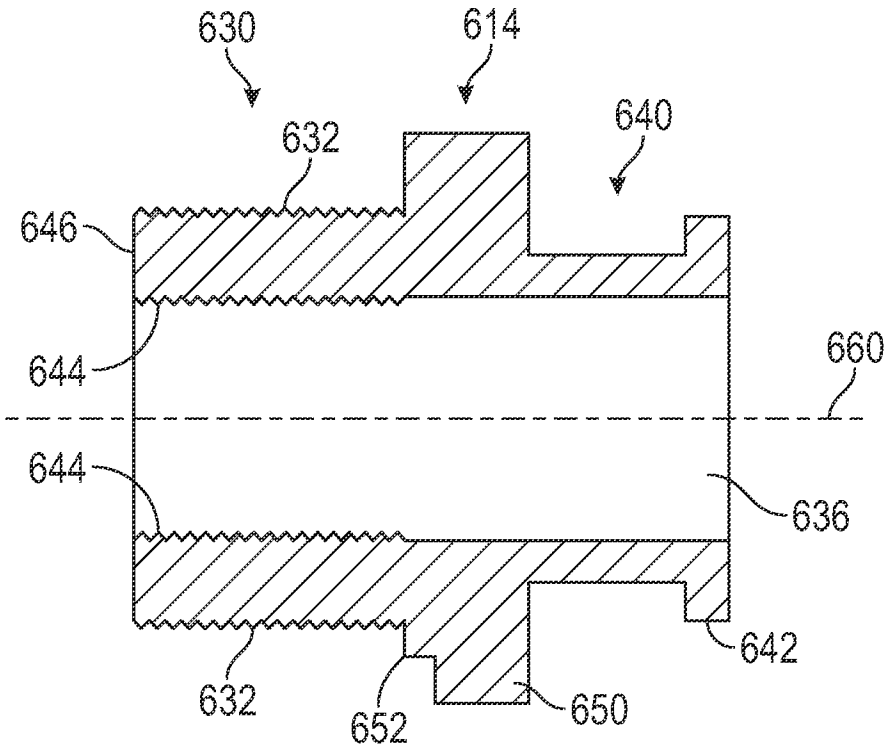
FIG. 6C is a cross-section view of a drain fitting of the vehicle of FIG. 1, according to an exemplary embodiment.
Figure 6B:
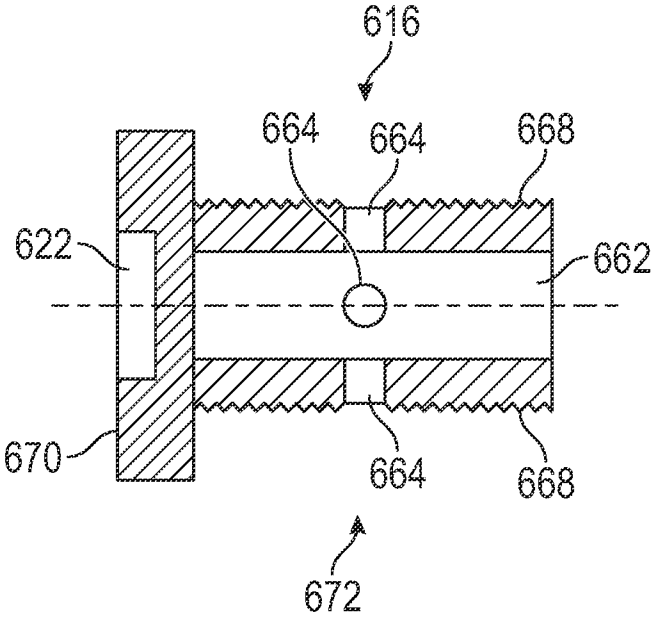
FIG. 6B is a cross-section view of a drain plug of the vehicle of FIG. 1, according to an exemplary embodiment.

Referring now to FIGS. 6A-6C, a drain fitting 614 and drain plug 616 is shown, according to an exemplary embodiment. Drain fitting 614 may be hollow (as shown and further described in FIG. 6C) may include a drain plug end 630, a hose end 640, a flange 650 at the intersection of the drain plug end 630 and the hose end 640, drain fitting internal threads 644 (as shown in FIG. 6C), outer drain fitting threads 632, and a drain plug interface 646 (as shown in FIG. 6C). The drain fitting 614 includes a longitudinal axis 660 extending through the drain plug end 630 and the hose end 640 and the flange 650. The drain fitting 614 has a hollow channel with inner surface 636 running along the longitudinal axis through which a fluid may pass. In some embodiments, the fluid is oil or other hydrocarbon.

The drain plug end 630 is generally cylindrical in shape having an inner diameter and an outer diameter (the drain fitting 614 hollow along the longitudinal axis 660). An inner surface of the drain fitting 614 has drain fitting internal threads 644 extending the length of the drain plug end 630. In some embodiments, the drain fitting internal threads 644 do not extend the entire length of the drain plug end 630. In some embodiments, the inner threads are M22. The inner threads are configured to be in threaded engagement with drain plug 616. The drain fitting 614 also has an outer surface 634. The outer surface 634 has drain fitting outer threads 632 thereon. Threads 632 may be any suitable thread dimension. In one example, the drain fitting outer threads 632 are M27. Flange 650 extends radially and outwardly from the drain plug end 630 and the hose end 642. The flange 650 is configured to have an outer diameter greater than a diameter of the drain fitting cutout 510 of FIG. 5. Drain plug end 630 is configured to have an outer diameter (including with the threads 632) to pass through the drain fitting cutout 510. This allows the drain plug end 630 to pass through the drain fitting cutout 510 until the flange 650.

The hose end 640 includes an outer diameter and an inner diameter. The hose end 640 also includes outer surface 654 and an inner surface 636. In some embodiments, the inner surface of the hose end is the same inner surface of the drain plug end. According to an exemplary embodiment, the outer diameter of the hose end 640 is smaller than the outer diameter of the drain plug end 630, as shown in FIG. 6A. However, in other embodiments, the outer diameter of the hose end 640 may be larger than, or equal to, the outer diameter of the drain plug end 630. The hose end 640 includes, in some embodiments, a hose barb 642. The hose barb 642 is used for securely coupling a hose to drain fitting 614 at the hose end 640. Hose barbs result in a secure connection between fittings and hoses, they facilitate installation of hoses onto fittings, and are cost effective as they do not require an extra component to securely couple hoses to fittings. In some embodiments, a hose clamp is used to more securely couple the hose to drain fitting 614. In some embodiments, the hose end has multiple hose barbs 642.

According to an exemplary embodiment, the drain plug 616 is shown in FIG. 6A-6B. The drain plug 616 includes a head 670, a shank 672, drain plug threads 668, ports 664, and an actuation interface 622. The drain plug threads 668 are configured with the same thread pitch as the drain fitting internal threads 644 so as to be threadedly engaged to the drain fitting internal threads 644. The head 670 is configured to interface with the drain plug interface 646 of the drain fitting 614 to form a mechanical seal. In some embodiments, a gasket or O-ring may be placed at the drain plug interface 646 to further seal the drain plug interface 646 when the drain plug 616 is engaged with the drain fitting 614. Drain plug 616 and/or drain fitting 614 may include grooves to accept the gasket or O-ring. The actuation interface 622 is utilized to engage and disengage the drain plug 616 from the drain fitting 614. In some embodiments, the actuation interface 622 is a hexagonal cutout, configured to receive a hex key. In other embodiments, the actuation interface 622 is a profile to accept a screwdriver head profile (e.g., flat, Phillips, torx, Robertson, star, security, etc.). In some embodiments, the actuation interface and the head 670 are the same component, for example, the head may be hexagonal, configured to accept a socket or wrench.

In some embodiments, the drain plug 616 has a hollow shank 672 (as shown in FIG. 6B). In these embodiments, the shank 672 may include ports 664. The ports 664 extend perpendicularly through the shank into the hollow portion 662. The drain plug 616 may have one or more ports 664. The ports are configured to allow a fluid to flow out from the hollow shank. These ports can be used to drain a fluid without removing the bolt completely. For example, the drain plug 616 may be threadedly engaged with the drain fitting internal threads 644 and form a mechanical seal with drain plug interface 646. An operator may begin removing the drain plug 616 by using an hex key with actuation interface 622 to loosen the drain plug 616. Upon the ports being exposed, oil may drain from the hollow portion 662 out of the drain plug 616, thus allowing an operator to change the oil of the vehicle without completely removing the plug. This saves time, avoids cross-threading the drain plug 616 upon reinstallation, and mitigates the potential to lose the drain plug.

Figure 8:
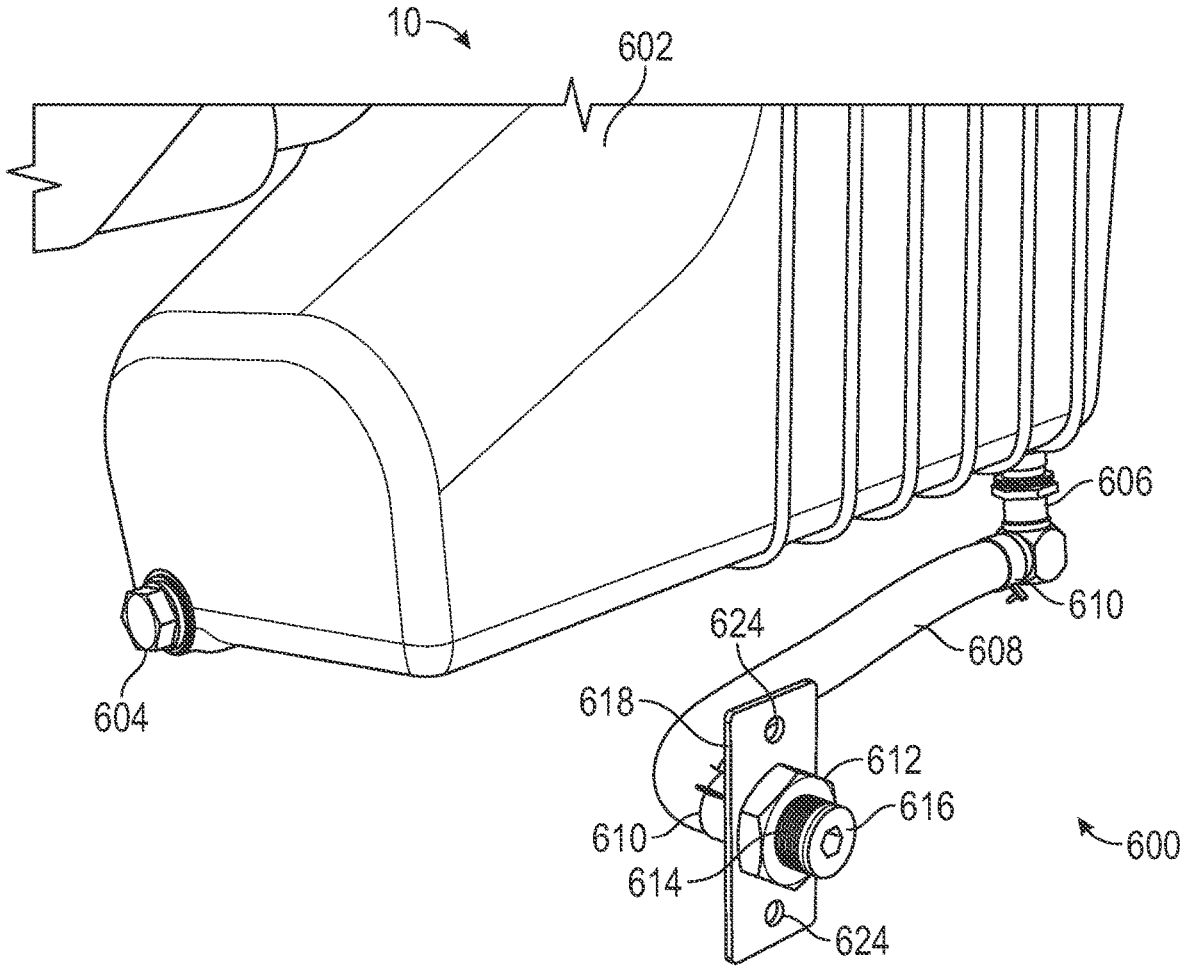
FIG. 8 is a perspective view of an oil pan and the drain fitting of the vehicle of FIG. 1, according to an exemplary embodiment.

FIG. 8 illustrates the remote oil drain system 600 as applied to the vehicle 10. Vehicle 10 includes an oil pan 602. The oil pan 602 is configured to receive and store oil to be used in the lubrication and cooling of engine 702 of FIG. 8. Oil pan 602 also includes auxiliary oil drain 604 through which an operator may drain the oil of oil pan 602. In some embodiments, the oil drain 604 may be inaccessible when the vehicle is assembled. In other embodiments, the oil drain 604 may difficult to access once the vehicle is assembled.

Oil pan 602 also includes, in some embodiments, a hose adapter 606. A first end of the hose adapter 606 is configured to threadedly engage with a threaded cutout on the lower surface of the oil pan 602 and create a mechanical seal thereat. In some embodiments, the hose adapter 606 has a second end, opposite that of the first end, that is configured to engage with the inner surface of hose 608. Just as hose end 640 of the drain fitting 614, the second end of the hose adapter 606 may include a hose barb to securely fasten the inner surface of the hose 608 to the second end of the hose adapter 606. In other embodiments, the hose adapter is built into the oil pan 602. In some embodiments, the oil pan 602 has a hose adapter 606 built into the oil pan 602, and consequently does not need an additional component to be in fluid communication with the hose 608.

The remote oil drain system 600 may include one or more of the following components: the hose 608, hose clamps 610, a mounting plate 618, the drain fitting 614, a jam nut 612, and the drain plug 616.

The drain hose 608 may be used to put the oil pan 602 (through the hose adapter 606) in fluid communication with the drain fitting 614. Because the oil drain 604 may be inaccessible after installation of the engine block, the remote oil drain system 600 may be needed to provide a convenient and accessible drain location to drain the oil from the vehicle 10. Using the hose 608, the manufacturer (or other) may route the oil to a convenient draining location for the operator. The hose may be made of any material, including rubber, PVC, silicone, polyurethane, Teflon, stainless steel, steel, aluminum, etc. The first end of hose 608 is attached to the second end of the hose adapter 606. In some embodiments, the hose is secured to the second end of the hose adapter 606 by a hose barb of the hose adapter. In other embodiments, a hose clamp 610 is used to more securely fasten the hose 608 to the hose adapter 606. The hose 608 is then routed to a location of the drain fitting 614. A second end of the hose 608 is securely and removeably fastened to the hose end 640 of the drain fitting 614 as described above. In some embodiments, the hose is permanently coupled to the drain fitting 614. In some embodiments, the hose clamp 610 is used to more securely fasten the hose 608 to the hose end 640 of the drain fitting 614.

Figure 14B:
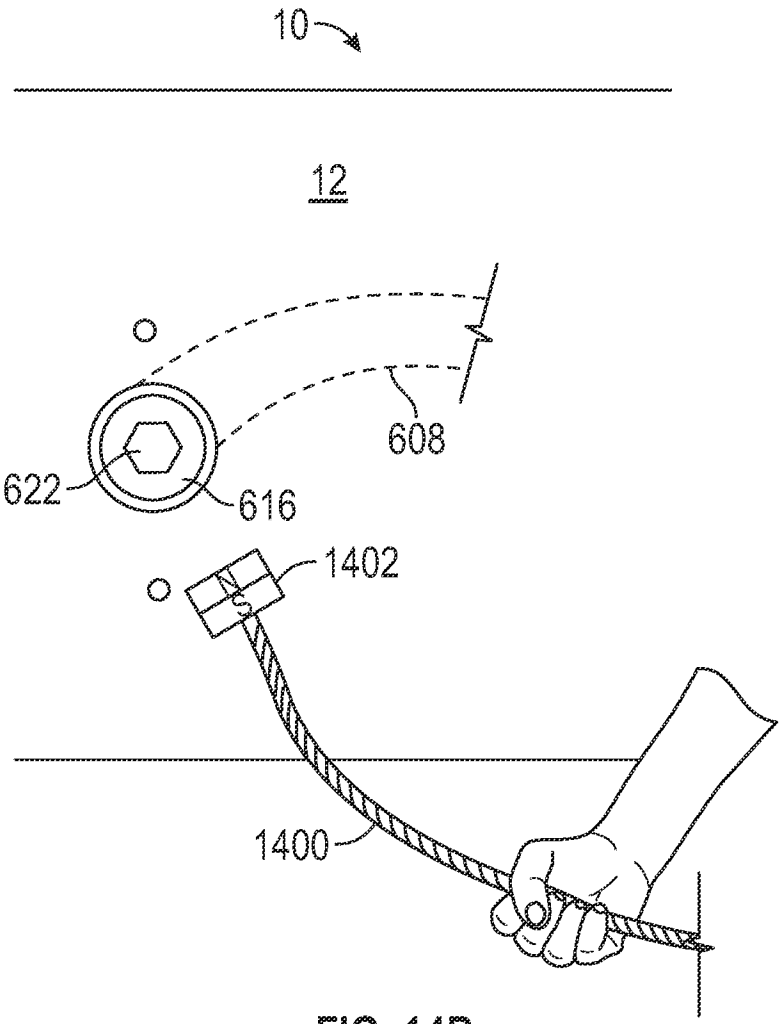
FIG. 14B is a side view of an installation process of the remote oil drain system onto the vehicle of FIG. 1, according to an exemplary embodiment.
Figure 14A:
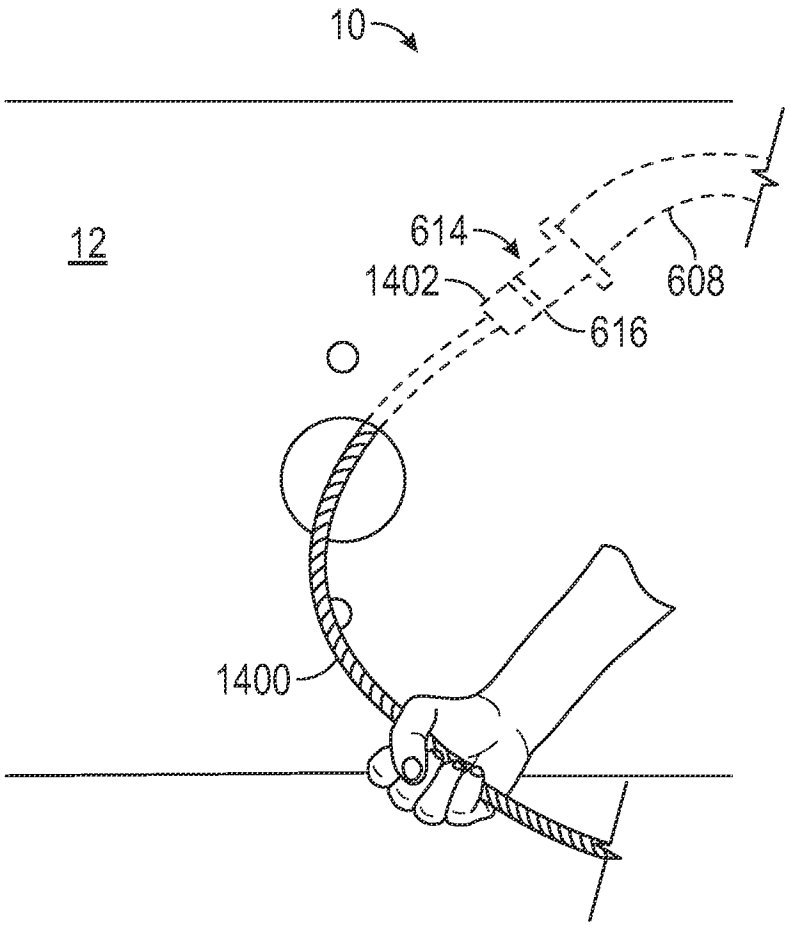
FIG. 14A is a side view of an installation process of the remote oil drain system onto the vehicle of FIG. 1, according to an exemplary embodiment.

The drain fitting 614 is then routed through the drain fitting cutout 510 as shown in FIG. 5. Turning now to FIGS. 14A-14B, the process of routing the drain fitting 614 through the frame 12 is illustrated. During the manufacture of the engine 702, the oil pan 602 is removeably attached to the bottom of the engine block. The hose adapter 606, the hose 608, the hose clamps 610, the drain fitting 614, and the drain plug 616 are installed and attached to the oil pan (through the hose adapter 606). The engine is then filled with oil to the operating level. Once filled, the engine may be lowered onto the vehicle. Before lowering, an installation member 1400 (e.g., a cable) is routed through the drain fitting cutout 510 from outside the vehicle 10 to the inside of vehicle 10, and removeably coupled to the drain fitting 614 or drain plug 616. In some embodiments, the drain fitting 614 or drain plug 616 is ferrous and the installation member 1400 has a magnetic end 1402 to which the drain fitting 614 or drain plug 616 is removeably coupled magnetically. In other embodiments, the installation member has a grabbing mechanism to attach to the drain fitting 614 or drain plug 616.

Figure 7:
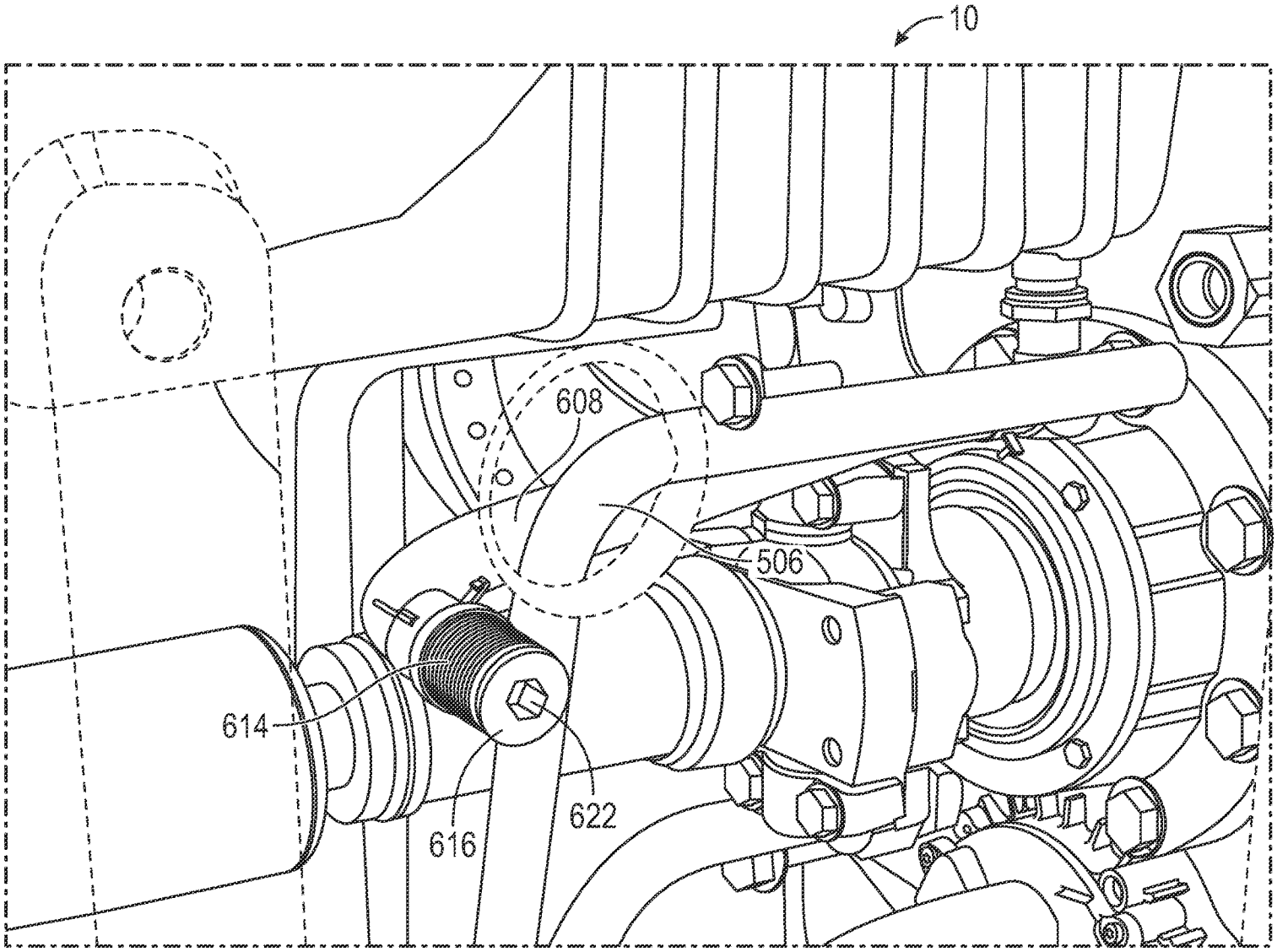
FIG. 7 is a perspective view of the drain fitting extending through the frame of the vehicle of FIG. 1, according to an exemplary embodiment.

As the engine 702 is lowered onto the chassis of vehicle 10, a user may pull the installation member 1400 back out of the drain fitting cutout 510, thereby bringing the drain fitting 614 through the drain fitting cutout 510 as well, as shown in FIG. 14B and FIG. 7.

Figure 9:
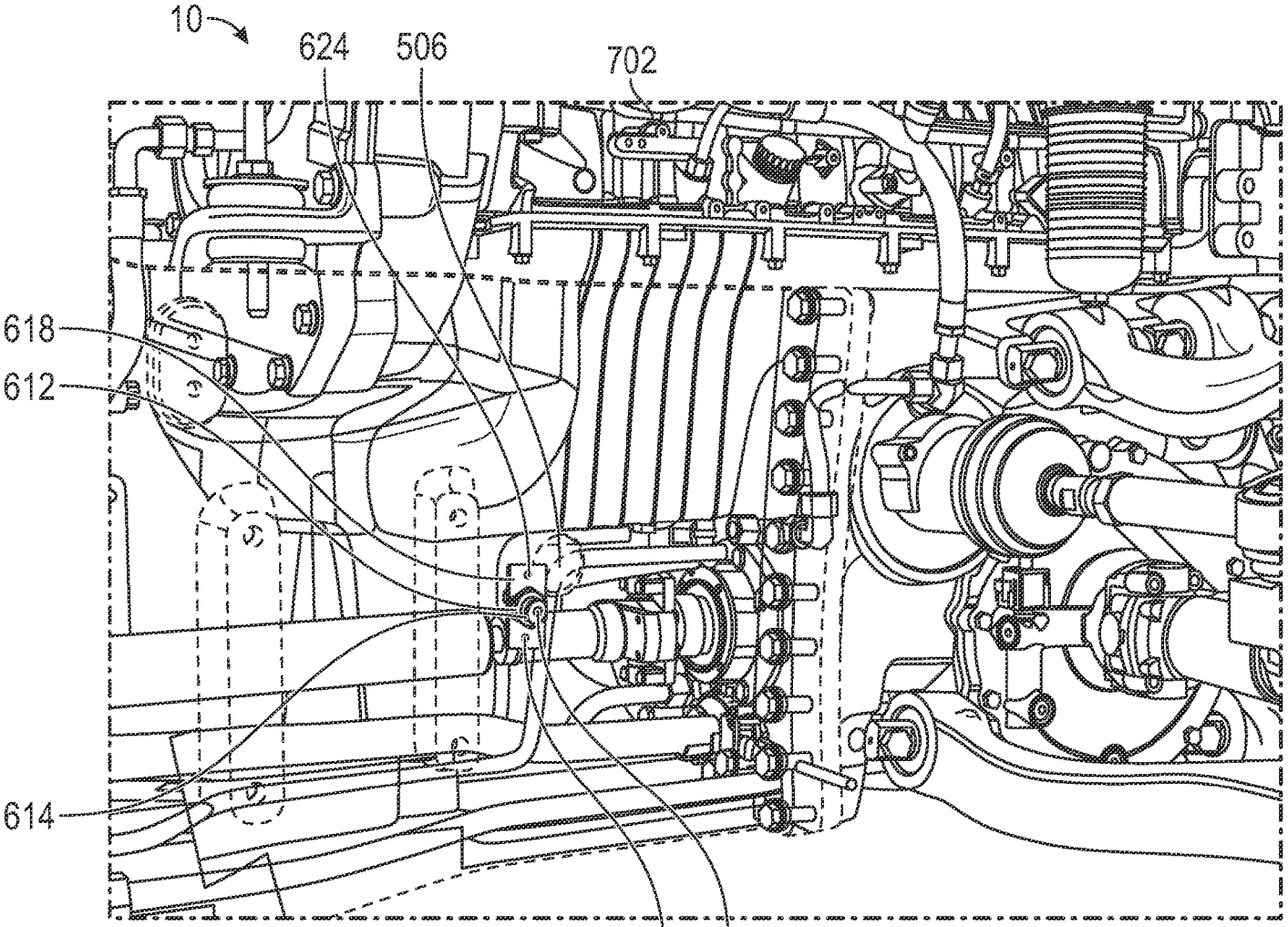
FIG. 9 is a perspective view of the frame of the vehicle of FIG. 1 with the drain fitting attached thereto, according to an exemplary embodiment.
Figure 10:
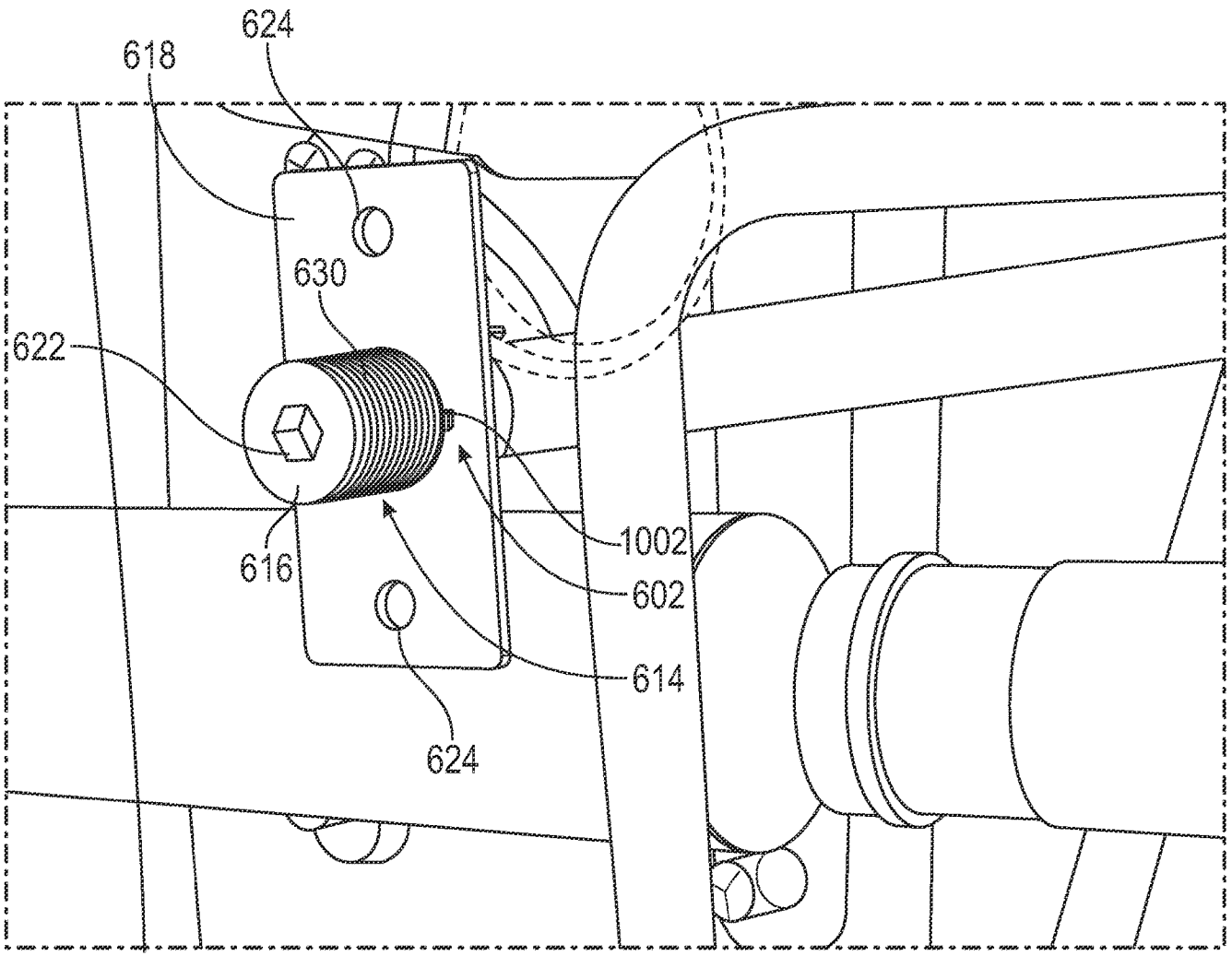
FIG. 10 is a perspective view of the drain fitting and a mounting plate of the vehicle of FIG. 1, according to an exemplary embodiment.

Turning now back to FIG. 9 and FIG. 10. When drain fitting 614 is pulled through the frame 12, it may interface with the mounting plate 618. As disclosed herein, in some embodiments, the flange 650 of drain fitting 614 is configured to interface with the mounting plate 618. The drain plug end 630 is pulled through a cutout in the mounting plate 618 until the flange 650 is proximate the face of the mounting plate 618. In some embodiments, the key 652 of the drain fitting 614 engages with a keyway feature 1002 (as shown in FIG. 10) of the cutout in the mounting plate 618. This key/keyway interface prevents the drain fitting 614 from rotating when mounted to the mounting plate. In some embodiments, the mounting plate 618 has more than one keyway feature 1002. In some embodiments, the mounting plate 618 has no keyway feature 1002.

Figure 11:
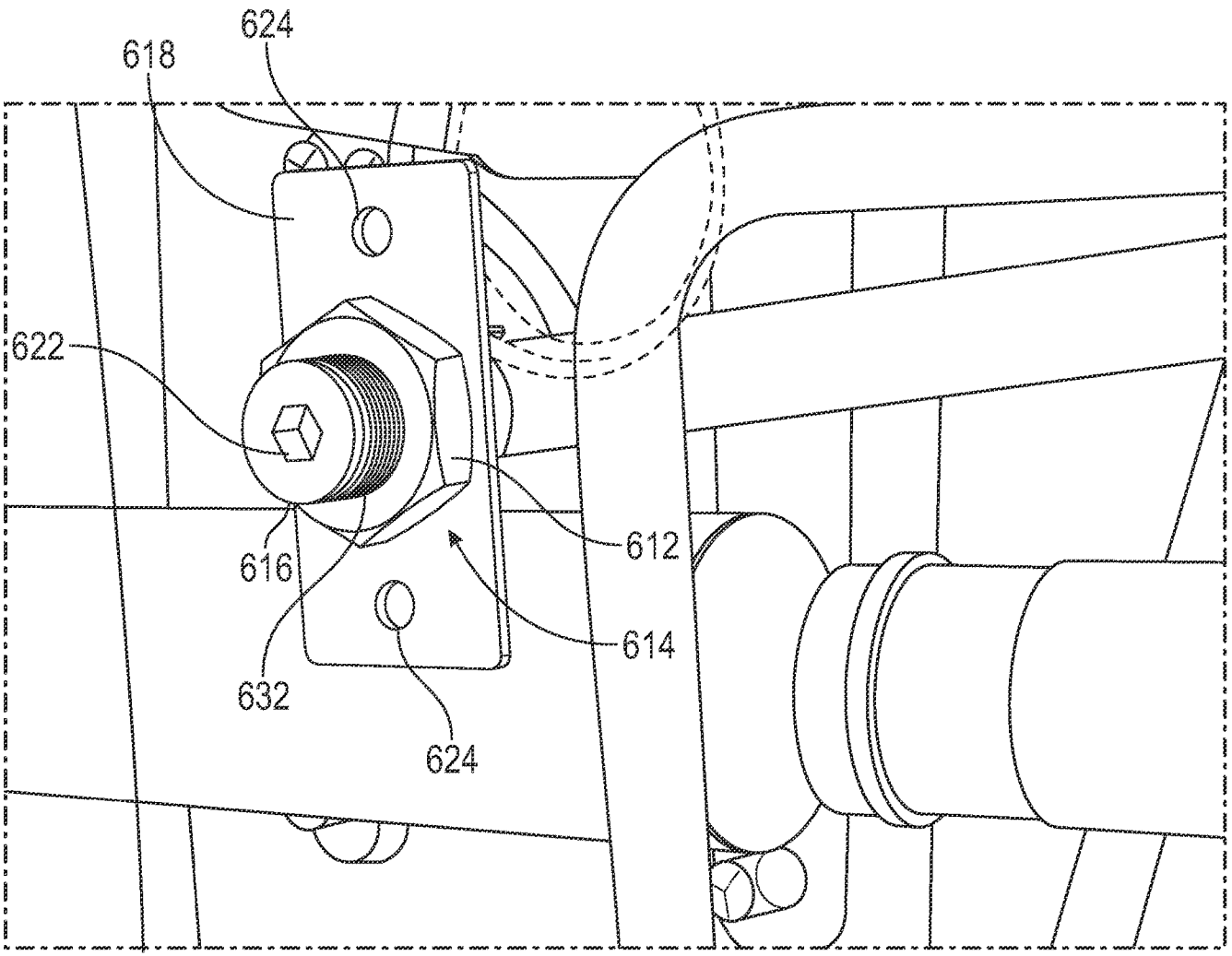
FIG. 11 is a perspective view of the drain fitting of the vehicle of FIG. 1 mounted to the mounting plate by a jam nut, according to an exemplary embodiment.
Figure 12:
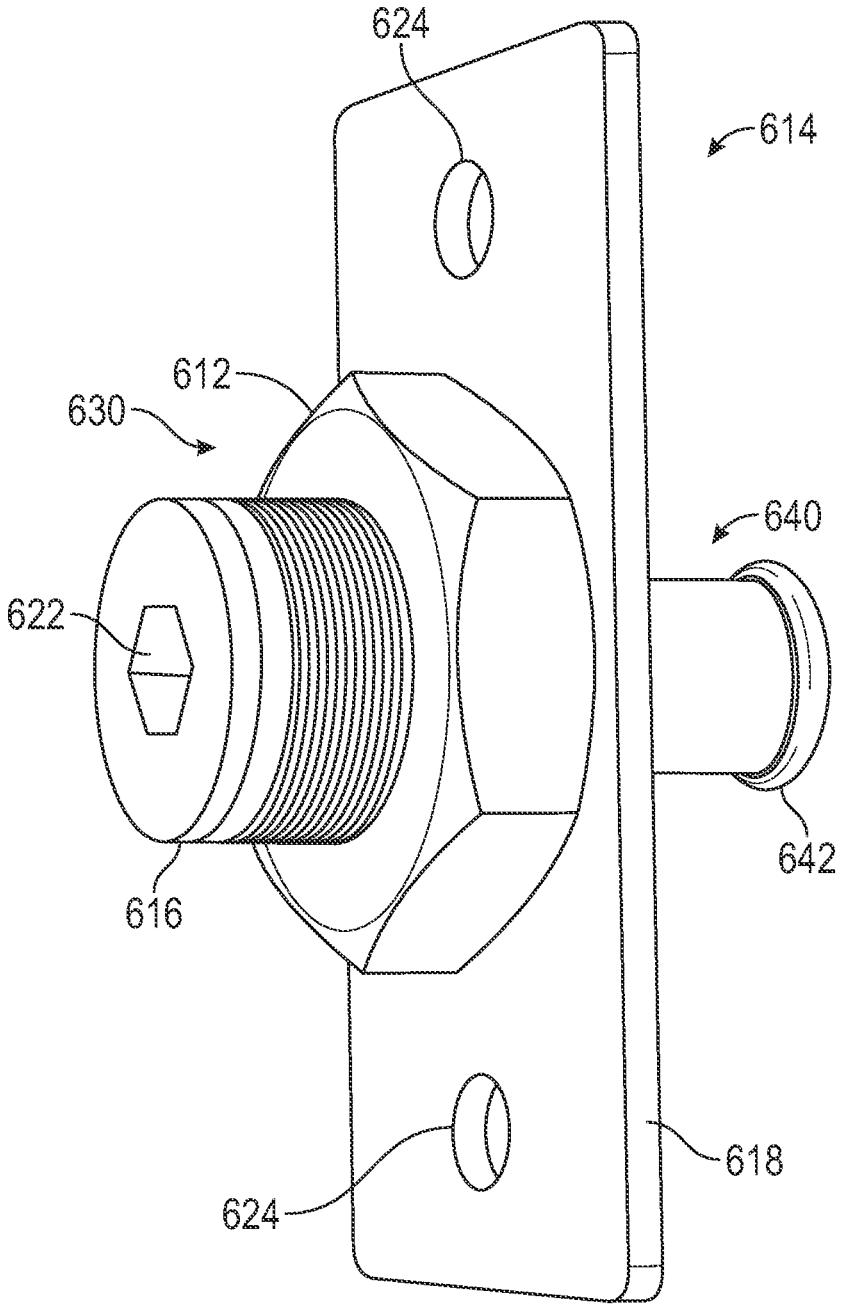
FIG. 12 is a perspective view of the drain fitting of the vehicle of FIG. 1 mounted to the mounting plate by a jam nut, according to an exemplary embodiment.

Turning to FIG. 11-12, with the drain fitting 614 extending through the mounting plate, a jam nut 612 is threadedly engaged with the drain fitting outer threads 632. The jam nut 612 is threaded onto the drain fitting outer threads until it comes into contact with the mounting plate 618, thereby "sandwiching" the mounting plate 618 between the flange 650 and the jam nut 612.

Figure 13:
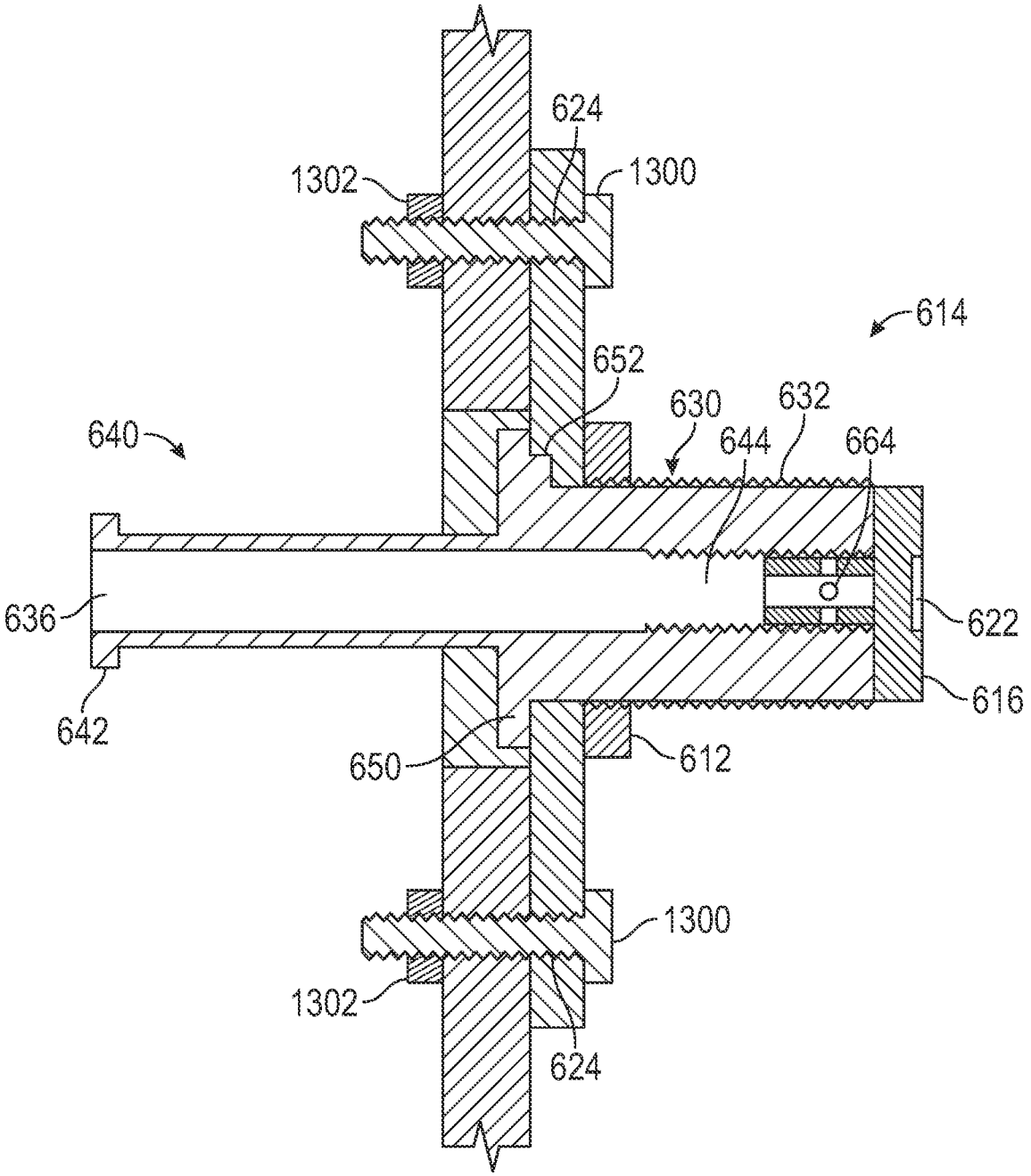
FIG. 13 is a cross-section view of the drain fitting of the vehicle of FIG. 1 mounted to the mounting plate by the locking nut, according to an exemplary embodiment.

Turning now to FIGS. 9 and 13. With the drain fitting 614 mounted to the mounting plate by the jam nut 612, the mounting plate 618 may be mounted to the frame 12. Mounting bolts 1300 may be placed through mounting holes 624 and corresponding holes in the frame 12. Once the mounting bolts 1300 are placed through the mounting plate 618 and frame 12, a nut 1302 may be placed on the mounting bolt 1300 to removeably couple the mounting plate to the frame.

Figure 15:
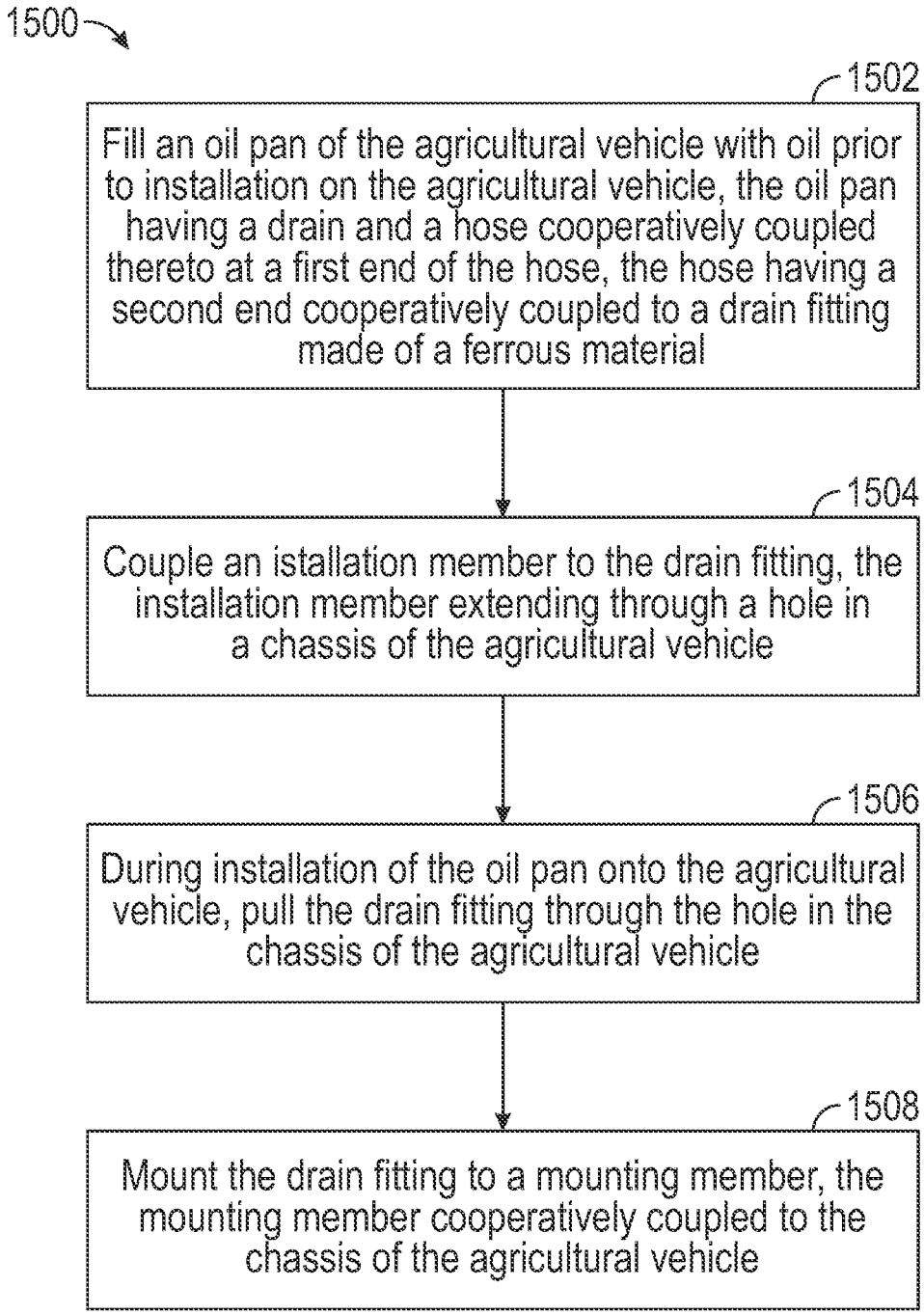
FIG. 15 is flow diagram of a process for installing the remote oil drain system, according to an exemplary embodiment.

FIG. 15 is a flowchart of an example process 1500, further described herein and illustrated in FIGS. 14A-14B. As shown in FIG. 15, process 1500 may include the following steps. Filling an oil pan of the agricultural vehicle with oil prior to the installation on the agricultural vehicle, the oil pan having a drain and a hose cooperatively coupled thereto at a first end of the hose, the hose having a second end cooperatively coupled to a drain fitting made of a ferrous material (step 1502). As also shown in FIG. 15, process 1500 may include coupling an installation member to the drain fitting, the installation member extending through a hole in a chassis of the agricultural vehicle (step 1504). As further shown in FIG. 15, process 1500 may include during the installation of the oil pan onto the agricultural vehicle, pulling the drain fitting through the hole in the chassis of the agricultural vehicle (step 1506). As also shown in FIG. 15, process 1500 may include mounting the drain fitting to a mounting member, the mounting member cooperatively coupled to the chassis of the agricultural vehicle (step 1508).

Process 1500 may include additional implementations, such as any single implementation or any combination of implementations described below and/or in connection with one or more other processes described elsewhere herein. In a first implementation, the mounting member is removeably coupled to the chassis of the agricultural vehicle.

In a second implementation, alone or in combination with the first implementation, the agricultural vehicle is a tractor.

In a third implementation, alone or in combination with the first and second implementation, the mounting member is irremoveably coupled to the chassis of the agricultural vehicle.

In a fourth implementation, alone or in combination with one or more of the first through third implementations, the installation member is magnetically coupled to the drain fitting.

In a fifth implementation, alone or in combination with one or more of the first through fourth implementations, the installation is physically coupled to the drain fitting.

Although FIG. 15 shows example blocks of process 1500, in some implementations, process 1500 may include additional blocks, fewer blocks, different blocks, or differently arranged blocks than those depicted in FIG. 15. Additionally, or alternatively, two or more of the blocks of process 1500 may be performed in parallel.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

The term "client or "server" include all kinds of apparatus, devices, and machines for processing data, including by way of example a programmable processor, a computer, a system on a chip, or multiple ones, or combinations, of the foregoing. The apparatus may include special purpose logic circuitry, e.g., a field programmable gate array (FPGA) or an application specific integrated circuit (ASIC). The apparatus may also include, in addition to hardware, code that creates an execution environment for the computer program in question (e.g., code that constitutes processor firmware, a protocol stack, a database management system, an operating system, a cross-platform runtime environment, a virtual machine, or a combination of one or more of them). The apparatus and execution environment may realize various different computing model infrastructures, such as web services, distributed computing and grid computing infrastructures.

The systems and methods of the present disclosure may be completed by any computer program. A computer program (also known as a program, software, software application, script, or code) may be written in any form of programming language, including compiled or interpreted languages, declarative or procedural languages, and it may be deployed in any form, including as a stand-alone program or as a module, component, subroutine, object, or other unit suitable for use in a computing environment. A computer program may, but need not, correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

The processes and logic flows described in this specification may be performed by one or more programmable processors executing one or more computer programs to perform actions by operating on input data and generating output. The processes and logic flows may also be performed by, and apparatus may also be implemented as, special purpose logic circuitry (e.g., an FPGA or an ASIC).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data (e.g., magnetic, magneto-optical disks, or optical disks). However, a computer need not have such devices. Moreover, a computer may be embedded in another device (e.g., a vehicle, a Global Positioning System (GPS) receiver, etc.). Devices suitable for storing computer program instructions and data include all forms of non-volatile memory, media and memory devices, including by way of example semiconductor memory devices (e.g., EPROM, EEPROM, and flash memory devices; magnetic disks, e.g., internal hard disks or removable disks; magneto-optical disks; and CD ROM and DVD-ROM disks). The processor and the memory may be supplemented by, or incorporated in, special purpose logic circuitry.

To provide for interaction with a user, implementations of the subject matter described in this specification may be implemented on a computer having a display device (e.g., a CRT (cathode ray tube), LCD (liquid crystal display), OLED (organic light emitting diode), TFT (thin-film transistor), or other flexible configuration, or any other monitor for displaying information to the user. Other kinds of devices may be used to provide for interaction with a user as well; for example, feedback provided to the user may be any form of sensory feedback (e.g., visual feedback, auditory feedback, or tactile feedback).

Implementations of the subject matter described in this disclosure may be implemented in a computing system that includes a back-end component (e.g., as a data server), or that includes a middleware component (e.g., an application server), or that includes a front end component (e.g., a client computer) having a graphical user interface or a web browser through which a user may interact with an implementation of the subject matter described in this disclosure, or any combination of one or more such back end, middleware, or front end components. The components of the system may be interconnected by any form or medium of digital data communication (e.g., a communication network). Examples of communication networks include a LAN and a WAN, an inter-network (e.g., the Internet), and peer-to-peer networks (e.g., ad hoc peer-to-peer networks).

It is important to note that the construction and arrangement of the vehicle 10 and the systems and components thereof (e.g., the driveline 50, the braking system 100, the control system 96, etc.) as shown in the various exemplary embodiments is illustrative only. Additionally, any element disclosed in one embodiment may be incorporated or utilized with any other embodiment disclosed herein.

The invention claimed is:

1. An agricultural vehicle comprising:

a chassis;

an oil pan, including a drain;

an oil pan drain hose having a first end and a second end, wherein the first end is cooperatively coupled to the drain;

a drain fitting including:

a hose end configured to be cooperatively coupled to the second end of the oil pan drain hose;

a drain plug end, the drain plug end having an externally threaded surface on an outer surface of the drain plug end and having internal threads on an inner surface of the drain plug end;

a flange, located at an intersection of the hose end and the drain plug end, the flange extending radially outward from the hose end and the drain plug end and having a key configured to prevent rotation upon interfacing with a corresponding keyway;

a drain plug, wherein the drain plug includes external threads on a threaded end configured to physically engage with the internal threads of the drain plug end of the drain fitting;

a mounting member, configured to be coupled to the chassis, the mounting member having a profile configured to allow the drain plug end of the drain fitting to pass through to the flange until the flange is located proximate a mounting member interior surface, the mounting member including a keyway in the profile to interlock with the key of the drain fitting; and a locking member with interior threads on a locking member interior surface for physically engaging with the externally threaded surface of the drain fitting and configured to removeably engage with the mounting member on an exterior surface of the mounting member.

2. The agricultural vehicle of claim 1, wherein the first end of the oil pan drain hose is cooperatively coupled to the drain by an adapter.

3. The agricultural vehicle of claim 1, wherein the drain fitting is made of a ferrous material.

4. The agricultural vehicle of claim 1, wherein the hose end of the drain fitting includes hose barbs configured to physically engage with the oil pan drain hose.

5. The agricultural vehicle of claim 1, wherein the locking member is a jam nut.

6. The agricultural vehicle of claim 1, wherein the mounting member is removeably coupled to the chassis.

7. The agricultural vehicle of claim 1, wherein the drain plug includes ports through the threaded end, configured to allow a fluid pass through for draining.

8. A remote oil drain system comprising:

a drain fitting including:

a hose end configured to be cooperatively coupled to a hose;

a drain plug end, the drain plug end having an externally threaded surface on an outer surface of the drain plug end and having internal threads on an inner surface of the drain plug end;

a flange, located at an intersection of the hose end and the drain plug end, the flange extending radially outward from the hose end and the drain plug end and having a key configured to prevent rotation upon interfacing with a corresponding keyway;

a drain plug, wherein the drain plug includes external threads on a threaded end configured to physically engage with the internal threads of the drain plug end of the drain fitting;

a mounting member, configured to be coupled to a chassis, the mounting member having a profile configured to allow the drain plug end of the drain fitting to pass through to the flange until the flange is located proximate a mounting member interior surface, the mounting member including a keyway in the profile to interlock with the key of the drain fitting; and a locking member with interior threads on a locking member interior surface for physically engaging with the externally threaded surface of the drain fitting and configured to removeably engage with the mounting member on an exterior surface of the mounting member.

9. The remote oil drain system of claim 8, wherein a first end of an oil pan drain hose is cooperatively coupled to a drain by an adapter.

10. The remote oil drain system of claim 8, wherein the drain fitting is made of a ferrous material.

11. The remote oil drain system of claim 8, wherein the hose end of the drain fitting includes hose barbs configured to physically engage with an oil pan drain hose.

12. The remote oil drain system of claim 8, wherein the locking member is a jam nut.

13. The remote oil drain system of claim 8, wherein the mounting member is removeably coupled to the chassis.

14. The remote oil drain system of claim 8, wherein the drain plug includes ports through the threaded end, configured to allow a fluid pass through for draining.

15. A method of safely installing a remote drain assembly during an installation onto an agricultural vehicle, the method comprising:

filling an oil pan of the agricultural vehicle with oil prior to the installation on the agricultural vehicle, the oil pan having a drain and a hose cooperatively coupled thereto at a first end of the hose, the hose having a second end cooperatively coupled to a drain fitting made of a ferrous material;

coupling an installation member to the drain fitting, the installation member extending through a hole in a chassis of the agricultural vehicle;

during the installation of the oil pan onto the agricultural vehicle, pulling the drain fitting through the hole in the chassis of the agricultural vehicle; and mounting the drain fitting to a mounting member, the mounting member cooperatively coupled to the chassis of the agricultural vehicle.

16. The method of claim 15, wherein the mounting member is removeably coupled to the chassis of the agricultural vehicle.

17. The method of claim 15, wherein the agricultural vehicle is a tractor.

18. The method of claim 15, wherein the mounting member is irremoveably coupled to the chassis of the agricultural vehicle.

19. The method of claim 15, wherein the installation member is magnetically coupled to the drain fitting.

20. The method of claim 15, wherein the installation is physically coupled to the drain fitting.

* * * * *